US009612094B1

(12) United States Patent
Collier

(10) Patent No.: US 9,612,094 B1
(45) Date of Patent: Apr. 4, 2017

(54) AXILINEAR SHAPED CHARGE LINER WITH PARABOLIC APEX

(71) Applicant: Innovative Defense, LLC, Smithville, TX (US)

(72) Inventor: Nicholas Collier, Smithville, TX (US)

(73) Assignee: Innovative Defense, LLC, Smithville, TX (US)

( * ) Notice: Subject to any disclaimer, the term of this patent is extended or adjusted under 35 U.S.C. 154(b) by 0 days.

(21) Appl. No.: 15/172,821

(22) Filed: Jun. 3, 2016

Related U.S. Application Data

(63) Continuation of application No. 14/724,497, filed on May 28, 2015, now Pat. No. 9,360,222.

(51) Int. Cl.
*F42B 1/00* (2006.01)
*F42B 1/028* (2006.01)
*F42B 33/00* (2006.01)

(52) U.S. Cl.
CPC ..... *F42B 1/028* (2013.01); *F42B 33/00* (2013.01)

(58) Field of Classification Search
USPC ..... 102/306, 475, 476; 166/297, 298; 175/4.6
See application file for complete search history.

(56) References Cited

U.S. PATENT DOCUMENTS 5,859,383 A * 1/1999 Davison ..... C06B 25/34 102/307
6,026,750 A * 2/2000 Nelson ..... F42B 1/02 102/307
8,037,828 B1 * 10/2011 Jakaboski ..... F42B 1/02 102/305
2005/0011395 A1 * 1/2005 Langan ..... F42B 1/032 102/476
2014/0123841 A1 * 5/2014 Clay ..... E21B 43/117 89/1.15

* cited by examiner

*Primary Examiner* — J. Woodrow Eldred
(74) *Attorney, Agent, or Firm* — Hemingway & Hansen, LLP; D. Scott Hemingway

(57) ABSTRACT

This invention is a shaped explosive device with a liner that has a parabolic apex, which can produce a purely planar symmetric jet. The half pipe liner in the present invention has a parabolic apex or pole toward the aft end, a "V" notch on each side of the concave wings toward the fore end, and liner base end on each wing. Liner resembles two angled half sections of thin walled pipe butted together at the apex or pole, and when properly driven by a high explosive will produce a spade shaped stretching Munroe jet that erodes a deep elongated hole in a target. Alternatively, this invention is a shaped explosive device with a liner that produces a single combination jet consisting of a forward rod portion and rearward flattened spade shaped portion, this jet has a velocity gradient form tip to tail. When applied in a circular or other polygonal shaped array the Axilinear shaped charges will produce extremely large diameter holes greater than the overall diameter of the array.

21 Claims, 12 Drawing Sheets

AXILINEAR SHAPED CHARGE LINER WITH PARABOLIC APEX

RELATED APPLICATION DATA

This application is a Continuation-in-Part Application that claims priority under 35 U.S.C. §120 to application Ser. No. 14/724,497 filed on May 28, 2015, issued on Jun. 7, 2016 as U.S. Pat. No. 9,360,222.

TECHNICAL FIELD OF INVENTION

The technical field of the invention relates to explosive devices and, in particular, shaped charge explosive devices having liners with a parabolic apex.

BACKGROUND OF INVENTION

As described in "The History of Shaped Charges" by Donald R Kennedy, the concept of shaping an explosive charge, in order to focus its energy was known in 1792. In 1884 Max von Forester conducted experiments in Germany showing that an explosive charge with a hollow cavity will focus the explosive energy and produce a collimated jet of high speed gasses along the longitudinal axis of the cavity. When this cavity is lined with a ductile metal it will produce a high speed collimated stretching jet of liquefied material capable of penetrating all known materials.

In 1888, while conducting research for the U.S Navy, at Newport R.I., Charles Munroe discovered that not only could explosive energy be focused, but lining the hollow cavity in the explosive with metal increased the penetration dramatically, the effect is commonly called the Munroe Effect. These discoveries were further studied in 1910 by Egon Neumann of Germany who conducted similar experiment's, which showed that a cylinder of explosive with a metal lined conical hollow cavity could penetrate through steel plates. The military implications of this phenomenon were not realized until the lead up to World War II.

In the 1930's flash x-ray technology was developed which allowed the in depth study of the Shaped Charge jetting process. With this new diagnostic, it was possible to take X-Ray pictures of the collapse of the liner and the resulting jet. This new diagnostic led to a more scientific and complete understanding of the Munroe principle and emphasized the power of shaped charges.

Generally, when a cylinder of explosive with a hollow conical cavity at one end is detonated at the center of the opposite end, the energy of the explosive is focused into a rod-like jet of high temperature, high pressure and high velocity gases along the axis of a conical cavity. This is an axisymmetric collapse and is generally known as the Munroe effect. The pressures created behind the detonation front in the explosive are of such magnitude that it causes the metal of the liner to liquefy and flow like a fluid. As the liner material is collapsed toward the axis of the hollow cavity, the flowing material radially converges, creating a rod-like stretching jet of high velocity, between five and ten kilometers per second.

These jets are primarily copper and will penetrate all known materials. The conventional shaped charge will give typically a hole size that is, in a semi-infinite target; could be as high as 20% of the diameter of the shaped charge. In order to achieve the greatest jet length and penetration depth, the jetting process of a shaped charge requires the liner material to reach a high temperature during collapse, which allows plastic flow of the collapsed liner material that produces a long stretching jet.

Plastic flow is accomplished by forcing the liner material under great pressures to collapse and converge radially onto the liners symmetrical axis. A typical linear or circular linear shaped charge liner has non-fluted or non-corrugated walls, is driven from only two dimensions and has insufficient convergence to cause plastic flow and high velocities, so these devices do not produce ductile stretching jets but instead produce explosively formed projectiles EFP.

Modern shaped charges are used for various purposes, such as oil field perforators, and they produce a long stretching rod-like metal jet that penetrates 4 to 8 charge diameters in steel and as much as three times deeper in masonry or rock. The average diameter of a 5 CD deep hole from these conventional shaped charges is less than 15% of the diameter of the explosive charge CD. These types of charges are designed to have long, stretching rod-like jets, primarily to penetrate the walls of a vehicle or other target, which has been the focus of a vast majority of research in this field. The small holes produced by these types of charges do not permit a follow-through device in the case of surgical destruction of a protected enclosure.

Modern shaped charges can produce a long stretching rod like metal jet that penetrates about 5 to 8 charge diameters in steel, deeper in masonry or rock. The average diameter of a five charge diameter CD through hole from these type charges is less than 15% of the explosive charge diameter. These small diameter holes made by conventional jets do not produce a hole of sufficient diameter to provide a means to deliver follow on shaped charges of equal charge diameter to the standoff needed from the bottom of a hole with the intent of making an equal size hole diameter and depth of penetration as the last charge.

There have been some specialized efforts by Halliburton to produce shaped charges other than conical type shaped charges for special purposes such as pipe cutting and anchor chain cutting. These type of charges are called linear shaped charges and use the Munroe principle to produce a thin sheet like jet with somewhat similar cutting power to the usual conical shaped charge. The liner is wide angle and the device is used against light structures such as wooden doors and thin walls. The vast majority of research and development in shaped charges over the past hundred years or so has been devoted to deep penetration in both military and commercial applications. Some efforts have been directed to increasing the internal angle of the liner and a shorter standoff.

Other devices using flexible linear shaped charges have been designed for breaching man-size holes in light walls, such as described in Wall AXE British, 1960. These line charge devices are collapsed from only two opposing directions producing a very irregular thin sheet-like jet that is unpredictable in its penetrating ability due to the lack of a simultaneous initiation along the apex of the line explosive. These line charges are limited in the thickness or toughness of the target they can address and are mainly used for light walls. Additionally, sometimes users such as police or firefighters are badly injured or killed trying to use these awkward and clumsy devices.

U.S. Pat. No. 7,753,850 places an interrupter along the jet axis inside the liner, in the flow path of the liner material. The permissible size of the interrupter for this concept can only be a small portion of the liner diameter so as to leave room for the liner to collapse. The small diameter of the interrupter does not form a large enough diameter jet to produce a full caliber hole or to hold its annular shape after it separates from the interrupter; the jet will converge into a rod and some of the precious liner length is wasted.

U.S. Pat. Publ. No. US2011/0232519 A1 shows outside and inside walls making up the circular trough of the liner. The mass of the outer wall of the liner trough, because of its greater diameter, is much greater than the mass of the inner wall. The outer wall is converging whereas the inner wall, with much less mass, is diverging; the same problem exists with the explosive quantities driving each wall of the liner. To obtain a circular or annular jet, these masses must be equal in forces when they converge on the projected axis of the liner cavity.

In steel-making, small conical shaped charges are often used to pierce taps that have become plugged with slag. Linear shaped charges, or line charges, are another type of shaped charge used in the demolition of buildings to cut through steel beams and collapse the building in a desired pattern. This type of flexible line charge creates a sheet-like jet from a two-dimensional collapse. SWAT teams and fire departments are another user of line charges, using the Munroe principle to generate high speed material for urban wall breaching and rescue. These line charges are very inefficient and difficult to initiate in a manner conducive to achieving their full potential. Very little research has been conducted in this area of shaped charge technology, and all of these applications of shaped charges would benefit greatly from a larger-diameter penetration capability.

Hole diameters in casing from these conventional charges are not greater than ½ inch in diameter. The expected perforated holes sizes can be inconsistent, varying in size to more than 50% from the target diameter. This inconsistency causes many fracturing operation issues, and small hole size limits product flow into and from the formation; if too small, the perforation will get fouled with debris and can stop flowing altogether. The hole diameter produced by a present day oil well perforator is only approximately 12% of its explosive charge diameter. Great efforts have been made over the last 50 or so years to enlarge the entry hole diameter in oil well casing without much success.

Some effort has been made with placing a conventional shaped charge ahead of the projectile in order to create a pilot hole in the rock; however, only a small gain in depth of penetration is achievable with this method because of the very small hole diameter produced by a conventional shaped charge. The hole diameter made by a conventional shaped charge jet is small, on the order of one-tenth the diameter of the explosive charge forming the jet, and it penetrates approximately 6-8 times the diameter of the charge in steel (more in rock or masonry).

There is clearly a need for innovation in this industry to have a shaped explosive device that produces a combination of a forward rod and rearward flattened Spade shaped stretching jet. There is also a need for innovation in the industry to product symmetrical spade shaped jet stream from a shaped charge device.

SUMMARY OF THE INVENTION

This invention is a shaped explosive device with a liner that has a parabolic apex, which can produce a purely planar symmetric jet. The half pipe liner in the present invention has a parabolic apex or pole toward the aft end, a "V" notch on each side of the concave wings toward the fore end, and liner base end on each wing. Liner resembles two angled half sections of thin walled pipe butted together at the apex or pole, and when properly driven by a high explosive will produce a spade shaped stretching Munroe jet that erodes a deep elongated hole in a target.

One embodiment of the shaped charge liner, alternatively, produces a jet stream consisting of a forward rod portion and rearward flattened spade shaped portion, this jet has a velocity gradient form tip to tail. The jet produced by the shaped charge is axisymmetric for the forward rod portion and planar symmetric for the aft wide spade portion somewhat like linear shaped charge, thusly termed the "Axilinear" shaped charge. This Axilinear device will produce a combination jet, consisting of a rod forward portion, followed by and connected to a planar symmetric wide spade shaped rear portion.

The high explosive billet has three distinct sections, a rear or boat tailed HE section "A" as measured longitudinally between HE initiation point and liner apex, a mid-section or full conic HE section "B" as measured longitudinally from apex to wing vertex, section "B" fully encompassing the liner conical section, and forward HE section "C" that contains two partial circumference wing HE sections as measured longitudinally from wing vertex to base ends that conform to the shape of the liner wing extensions. The EW liner is the working material of the shaped charge and is mounted to body at the forward end of device, at the base ends of the liner wing extensions; and adjacent to the wings the liner parabolic faces are mounted to the body parabolic faces.

The body of the explosive device consists of four distinct areas, a aft cylindrical area that provides mounting for an initiation device that is coupled to the aft end of HE device, followed by a boat tailed area that contains the rear HE section A, followed by cylindrical area that contains mid-section HE section B that is coupled to the full conical liner section; and forward HE section C containing wing sections that are coupled to the extended wings of liner section, and body area at the forward end of cylindrical section that transitions from a cylindrical shape into two parallel flat parabolic faces that are planar symmetric to each other and are coupled to the parabolic liner faces.

Body area has two functions—it provides two opposing side mounting faces for the liner extended wings and also has flat faces that is the forward containment boundary of HE section; this boundary is located at wing vertex, and is also the liner wing transition point from the full circumference conical section to the extended wing section. The containment of HE pressures during the detonation time period by body area is important for proper collapse of the wings and spade jet formation.

The rod or axisymmetric portion of the jet produces a large diameter deep penetration and the flattening of the rear portion causes the jet to spread in two opposing directions which produces a wide flat jet that gives a penetration of an elongated slot. The forward rod portion of each jet erodes a round hole in the target followed by the aft flattened spade portion of the jet creating a long slotted deep cavity centered on the round hole and in the lateral direction of the spade jet. The purpose for producing a dual purpose or hybrid jet where the forward portion being a focused small diameter rod and the aft portion being spread into a flattened wider spade like jet is so that the jet energy is spread over a bigger area and produces a larger detonation hole, or a shape for the detonation hole that is different than a round hole, in a target while simultaneously maintaining control of the direction of the elongation of the hole.

Although there are other designs and shapes possible, the circular arrangement offers the most efficient removal of target material. The circular design also offers the symmetry needed and ease of fabrication and deployment. A single Axilinear shaped charge device is capable of producing two types of penetrations in a common hole, which includes a linear slot combined with a deep hole penetration.

A smooth walled circular linear liner by having opposing corrugations or flutes that have sufficient curvature to converge the liner material so as to obtain ductile Munroe jetting, longer jets, and higher velocities. Since jet length and depth of target penetration, are directly proportional, it is reasonable to make the greatest effort to provide the longest and most robust jet possible.

DESCRIPTION OF THE FIGURES

The inventor will use descriptive drawings and text to describe the device and how it functions.

DETAILED DESCRIPTION OF THE PREFERRED EMBODIMENTS

This invention is a shaped explosive device with a liner that has a parabolic apex, which can produce a purely planar symmetric jet. The half pipe liner in the present invention has a parabolic apex or pole toward the aft end, a "V" notch on each side of the concave wings toward the fore end, and liner base end on each wing. Liner resembles two angled half sections of thin walled pipe butted together at the apex or pole, and when properly driven by a high explosive will produce a spade shaped stretching Munroe jet that erodes a deep elongated hole in a target.

One embodiment of this invention also relates to shaped explosive devices and in particular to a shaped explosive device that produces a combination of a forward rod and rearward flattened Spade shaped stretching jet. This explosive device herein after referred to as "The Axilinear" device or Axilinear shaped charge, consists of a liner, an explosive billet, a body and a means of initiation. The invention described and depicted herein produces a two part stretching jet, the forward portion is a rod like jet and the aft portion is spread into a spade like shape reminiscent of the jetting of a linear shaped charge but at much higher velocities, having a velocity gradient or stretch rate and directionally controllable.

For clarity, all references in this document to a shaped charge means, "a shaped charge" is an explosive device, having a shaped liner, driven by a similarly shaped mating explosive billet, having an initiation device, the necessary containment, confinement and retention of the liner to the explosive billet. The result of detonation of this device is a high speed stream of material produced from the convergence of the liner driven by the explosive. This is commonly known as the Munroe Effect. The shape and size of this stream of material commonly called a jet, is dependent on the starting shape and size of the liner and explosive billet.

The Axilinear liner in the present invention consists of two sections, aft section "B", and forward section "C." The aft section "B" is a full circumference of one of, or combination of the liner profiles, shown in the figure section of this document. This section B produces an axisymmetric rod like stretching jet with length proportional to the length of the liner section, the stretch rate, and time of flight of the jet.

The forward section "C" consists of less than full circumference walls extending beyond the end of section B, these wing extensions are symmetrically one hundred eighty degrees apart. These wing extensions have axisymmetric cavity as viewed from inside the hollow liner form, this cavity functions to provide the convergence and work into the liner material to cause it to rise in temperature and ductility causing plastic flow. The jet from section C produces a planar symmetric stretching wide non round jet which cuts a slot rather than a round hole as produced by the rod portion of the jet.

Figure 1:
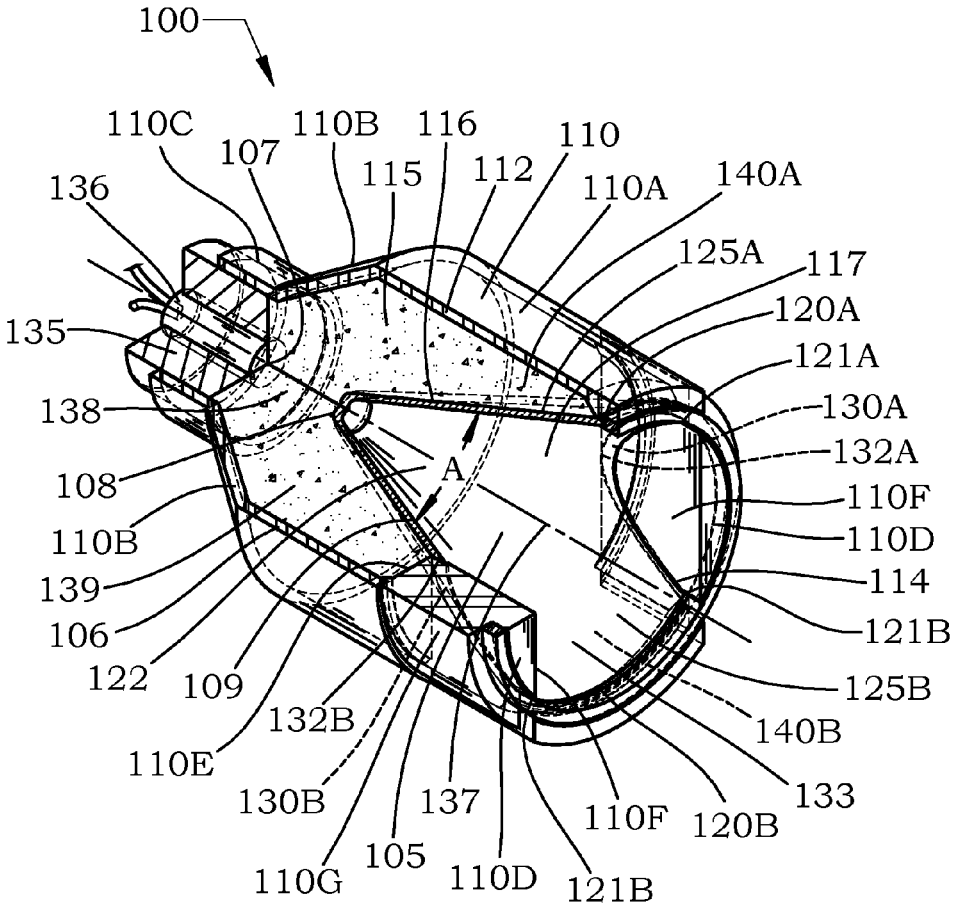
FIG. 1 is a quarter cut sectional perspective view of a single Axilinear shaped charge device.

More particularly, the Axilinear shaped charge device 100 shown in FIG. 1, consist of a body 110, EW liner 105, high explosive (HE) billet 115, having an axisymmetric aft area with detonator 136, detonator holder 135, detonation initiation point 107, and liner apex 108, and a axisymmetric as well as planar symmetric (Axilinear) fore area that consists of liner extended wings 125A and 125B and liner base ends 120A and 120B. Initiation of the HE billet of this novel device can be achieved by any suitable readily available detonation initiation devices.

Device 100 is axisymmetric or symmetrical about a longitudinal axis 137 from the aft end near detonator 136 to the middle liner wing vertex 132A and 132B of the EW liner 105; forward of wing vertex 132A and 132B device 100 is Axilinear with two symmetrical curved extended wings 125A and 125B being axisymmetric with axis 137 and also planar symmetric about two central perpendicular reference planes, a horizontal plane in the 3 and 9 o'clock positions, and a vertical plane in the 12 and 6 o'clock positions.

The vertical 12 and 6 o'clock reference plane (FIG. 2 vertical plane 246) is coincident with axis 137 and passes through the middle of each extended wing 125A and 125B, the parabolic faces 130A and 130B are planar symmetric or mirrored about this plane. Front edge 114 of face vacancy or void in the winged vertex 132A of the liner 105. The horizontal 3 and 9 o'clock reference plane (FIG. 2 horizontal collapse plane 245) is coincident with axis 137 and passes through each wing vertex 132A and 132B, this plane is also known as the wing collapse plane and the wings 125A and 125B are planar symmetric or mirrored about this plane. The jet produced by detonating an Axilinear shaped charge device 100 is axisymmetric for the forward rod portion of the jet and planar symmetric for the aft portion, this aft spade portion of the jet being shaped somewhat like a linear shaped charge jet, thusly named Axilinear.

The Axilinear shaped charge device 100 is shown with a conical EW liner 105, other geometrical shaped (i.e. hemispherical, tulip, or trumpet) hollow cavity formed liners with extended liner wings can also be used. EW liner 105 has a full circumference axisymmetric conical profile section 122 with included angle A that is longitudinally between aft apex 108 and middle liner wing vertex 132A and 132B, and a Axilinear partial circumference wing section 133 toward the fore end with two symmetrically opposing conical fluted wing extensions 125A and 125B with included angle A that extend longitudinally from the middle liner wing vertex 132A and 132B to the forward liner base ends 120A and 120B.

The forward liner wing extensions 125A and 125B are symmetrical to each other and positioned one hundred and eighty degrees apart, opposing each other planar symmetrically about the horizontal plane and is axisymmetric about longitudinal axis 137 of the device. The absence of liner wall material on opposing sides of the wing section 133 at the forward base end of the liner forms two parabolic faces 130A and 130B that are parallel and symmetric with each other about longitudinal axis 137 and the vertical plane. Both liner parabolic faces 130A and 130B have a vertex at wing vertex 132A and 132B and open toward the base ends 120A and 120B with parabolic end points at the wing arc ends 121A and 121B.

EW liner 105 maintains its conical profile and liner wall 109 thickness profile from aft end apex 108 of the full circumference conical section 122 to wing vertex 132A and continues with the same profile to the fore end of the extended wings 125A and 125B at the base ends 120A and 120B of the partial circumference wing section 133. Liner wall 109 transitions from a full circumference conical profile at wing vertex 132A and 132 B into 180 degree symmetrically opposing wing like or fluted extensions 125A and 125B that extend from the full circumference conical profile section 122 at wing vertex 132A and 132B to the base end 120A and 120B of the liner.

The liner wing extensions 125A and 125B shown in FIG. 1 retain the same curvature, included angle A, and wall 109 thickness profile as the full conical profile section 122 portion of the liner; but the extended wings 125A and 125B could also have a larger or smaller included angle A and wall thickness 109 than the conical section 122, as long as they maintain planar symmetry to one another. Being planar symmetric and having partial circumference conical curvature allows the wing-like extensions or flutes 125A and 125B to converge at very high pressures on the collapse plane, raising the temperature and ductility of the converging wing material to the required level for Munroe jetting.

HE billet 115 can be pressed, cast or hand packed from any commercially available high order explosive. HE billet 115 is in intimate contact with the outer liner surface 116 of EW liner 105 from the aft apex 108 to the forward wing vertex 132A and 132B of the conical profile section 122 and from the wing vertex 132A and 132B to the base ends 120A and 120B and wing arc ends 121A and 121B of the wing section 133. HE billet 115 has three distinct sections, a head height or aft HE section "A" 138 as measured longitudinally between HE initiation point 107 and liner apex 108, a mid-section or full conic HE section "B" 139 as measured longitudinally from apex 108 to wing vertex 132A and 132B, that fully encompasses the liner conical section 122, and forward HE section "C" that contains two partial circumference wing HE sections 140A and 140B as measured longitudinally from wing vertex 132A and 132B to base ends 120A and 120B that conform to the shape of the liner wing extensions 125A and 125B.

HE section A 138 can be lengthened or shortened longitudinally by increasing or decreasing the length of body 110, greater head height gives a flatter detonation wave before it comes in contact with the liner. Flatter detonation waves at time of liner impact typically increase jet tip velocity and target penetration, head height optimization is a balance between jet performance and minimizing the explosive charge. The optimum head height can be determined by computer code and live testing to obtain the least amount HE volume needed to efficiently obtain maximum jet mass, velocity and target penetration. A typical head height for a conical lined shaped charge would be ½ inch space permitting.

The shape and volume of HE section B 139 is defined by the area between the inside surface 112 of body 110 and outside surface 116 of EW liner 105 from aft apex 108 to forward body face 110E located at wing vertex 132A and 132B, and makes a full circumference or revolution around liner section 122. The shape and volume of the two symmetrical wing HE sections 140A and 140B of HE section C are defined by the area between the inside surface 112 of body 110 and outside surface 116 of EW liner 105 from aft wing vertex 132A and 132B to forward base ends 120A and 120B, and are partial circumference volumes about each wing between the wing arc end points 121A and 121B. HE billet 115 can have a super-caliber diameter (i.e. larger than the liner base diameter) necessary for full convergence of the base end of the liner wing extensions 125A and 125B to obtain maximum velocity and mass of the spade jet.

The forward section C 133 consists of two less than full circumference liner walls 109 extending beyond the end of section B 122, creating partial conical or curved wing extensions 125A and 125B, wing vertices 132A and 132B and parabolic faces 130A and 130B that are symmetrically one hundred and eighty degrees apart. The wing vertex 132A and 132B and flat parabolic faces 130A and 130B are formed from the absence of material on two symmetrically opposing sides of the base end of the conical profile. The wing extensions 125A and 125B create an axisymmetric and planar symmetric opposing partial radial hollow concavities on the inside liner wall surface 117; HE detonation pressures on these concavities provides a partial radial convergence and work into the liner material to cause it to rise in temperature and ductility causing plastic flow and hydrodynamic jetting.

The collapse of the wing extensions 125A and 125B of section C 133 produces a wide planar symmetric stretching non round spade shaped jet which cuts a deep slot rather than a round hole; the mass, width, length, stretch rate, velocity, and time of flight of the spade jet is directly proportional to the liner wall length of section C 133, included angle A, and liner wall 109 thickness of section C 133. If section C 133 is shortened and the overall length "L" is unchanged section B 122 will become longer. Increasing the length of section B 122 will increase the rod jet length, mass and penetration depth, and will decrease the length, width, mass and penetration depth of the spade jet; length adjustments to sections B and C work in concert, when the rod jet is lengthened the spade jet will be shortened and vice versa shortening the rod jet will lengthen the spade jet.

During collapse of the liner full conical section 122, liner material radially converges along the longitudinal axis 137 into a rod jet from the detonation of HE section A 138 and HE section B 139; the collapse of full conical section 122 is followed by the collapse of the extended liner wings 125A and 125B of the partial circumference section 133 into a spade jet from the detonation of wing HE sections 140A and 140B of HE section C. Wing HE sections 140A and 140B are coupled to the outer liner surface 116 of each wing from the aft wing vertex 132A and 132B to the forward wing base ends 120A and 120B and the wing arc ends 121A to 121B.

The radial curvature of the opposing liner wing extensions 125A and 125B provides the radial material convergence during collapse needed to raise the temperature and pressure of the collapsed liner material, to the required level for plastic flow and Monroe jetting to occur, this increases the ductility allowing for longer jet breakup length. During collapse, the full conical section 122 of the liner will form a axisymmetric rod jet along the longitudinal axis 137 followed by the concave liner wing extensions 125A and 125B being driven to a common collapse plane by HE 140A and 140B, the colliding wing extensions material will form into a high velocity flat planar symmetric spade shape jet.

As the collapsed wing extensions material moves forward along longitudinal axis 137 it also spreads laterally outward forming the spade shaped jet along the horizontal collapse plane. The formation of the spade jet is due to the absence of liner material, explosive and confinement on the liner sides with the two flat parabolic faces 130A and 130B that are adjacent to and ninety degrees out of phase from the flutes or wing extensions 125A and 125B. The orientation of device 100 can be rotated about axis 137 and the spade jet orientation will rotate equally in the same direction, if device 100 is rotated 45 degrees clockwise about axis 137 the collapse plane will also rotate 45 degrees clockwise and the spade jet will stretch longitudinally forward on axis 137 and laterally along the rotated collapse plane.

The EW liner 105 is the working material of the shaped charge and is mounted to body 110 at the forward end of device 100, at the base ends 120A and 120B of the liner wing extensions 125A and 125B; and adjacent to the wings the liner parabolic faces 130A and 130B are mounted to the body 110 parabolic faces 110F. Body 110 consist of four distinct areas, a aft cylindrical area 110C that provides mounting for an initiation device that is coupled to the aft end of HE 115, followed by a boat tailed area 110B that contains the HE section A 138, followed by cylindrical area 110A that contains HE section B 139 that is coupled to the full conical liner section 122; and HE section C containing wing sections 140A and 104B that are coupled to the extended wings of liner section 133, and body area 110D at the forward end of cylindrical section 110A that transitions from a cylindrical shape into two parallel flat parabolic faces 110F that are planar symmetric to each other and are coupled to the parabolic liner faces 130A and 130B.

Body area 110D has two functions, it provides two opposing side mounting faces 110F for the liner extended wings and also has flat faces 110E that is the forward containment boundary of HE section 139; this boundary is located at wing vertex 132A and 132B, and is also the liner wing transition point from the full circumference conical section 122 to the extended wing section 133. The containment of HE pressures during the detonation time period by body area 110D is important for proper collapse of the wings and spade jet formation. Shape charge liners for the most part are made from copper but liners may be made from most any metal, ceramic, powdered metals, tungsten, silver, copper, glass or combination of many materials. Body 110 would typically be made from aluminum or steel but could be made of almost any metal or plastic as long as it provides the correct amount of tamping for proper jet formation and desired jet velocity during the detonation of HE billet 115.

The EW liner 105 is a modified cone or other shape with two distinct geometrical sections, the aft end of the liner is a full conical profile section 122 with an apex 108, followed by the forward end wing section 133 with two liner wing extensions 125A and 125B that extend forward from the full conical or other shape profile section 122 at wing vertex 132A and 132B to the wing base ends 120A and 120B at the fore end of EW liner 105. The liner wing extensions 125A and 125B maintain the same included angle A liner wall 109 thickness profile and curvature of the full conical profile section 122.

The included angle A of EW liner 105 needed to obtain Munroe effect jetting should be from 36 to 120 degrees. The jet velocity achieved from a shaped charge is dependent on the liner wall 109 thickness and included angle A of the liner; a narrower included angle results in a faster less massive jet, and a wider included angle results in a slower more massive jet. Jet velocities can vary from 4 to 10 km/s depending on the type and quality of liner material, included angle A of the liner, liner wall 109 thickness, the charge to mass ratio of HE to liner, bulk density of the liner, surface finish of the liner wall, and body geometries; very small changes of any of these variables can make large differences in jet velocity and trajectory.

The HE billet 115 is contained between the inner surface 112 of body 110 and the outer surface 116 of the EW liner 105. HE billet 115 provides the energy to collapse the EW liner 105, increasing the ductility of the EW liner 105 material, causing it to form a compound jet in the shape of a very high speed rod jet from the full conical section 122 material followed by a flattened spade shaped jet from the liner wing section 133 material; the spade jet is slower than the rod jet from conical section 122 but much faster than a typical "V" shaped liner found in common linear shaped charge because of the cavity of the wing section 133.

Body 110 provides a mounting surface for EW liner 105 which is held to body 110 at the liner base ends 120A and 120B and at the parabolic faces 130A and 130B. The base end of EW liner 105 does not form a full circumference; it consists of two opposing concave surfaces or wing extensions 125A and 125B and the corresponding wing base ends 120A and 120B at the forward end of the liner. Body 110 also serves as a containment vessel for the delicate HE billet 115 and protects it from damage or impact by supporting the outer diameter of HE billet 115. Body 110 also provides tamping for the HE billet 115 depending on body wall 106 thickness and material density, HE tamping can be increased or decreased if needed to improve jet performance or reduce total HE mass.

The purpose of removing the base end material on symmetrically opposing sides of EW liner 105 and creating the wing-like extensions 125A and 125B is twofold. The first purpose is to form the partial circumference conical wing-like extensions or flutes 125A and 125B and when collapsed converge to form the flat aft spade shaped portion of the jet; the flattened spade jet spreads laterally and erodes an elongated slot in target material. The second purpose being to allow for close lateral proximity of multiple adjacent devices resulting in multiple tightly spaced rod and intersecting spade jet perforations, creating a large coupled slotted target perforation.

Since the EW liner 105 material is not being confined along the two removed portions of the liner at parabolic faces 130A and 130B, the collapse of the wing-like extensions or flutes 125A and 125B will produce a flat jet, much like a linear shaped charge, but at a much higher velocity, stretching laterally and longitudinally. The transition from the conical profile section 122 to the remaining wing-like extensions or flutes 125A and 125B of EW liner 105 is very gradual so as to maintain continuity between the rod and spade portions of the jet.

The shaped charge body 110 has a frustoconical or boat tailed portion 110B near the aft end of the shaped charge device 100 that begins at detonator holder 135 and increases in diameter longitudinally to about the apex 108 of EW liner 105. The cylindrical portion 110A of the body 110 begins at about the apex 108 of the EW liner 105 and extends longitudinally to the forward end of device 100. The forward end of cylindrical portion 110A has two planar symmetrical 110D portions, each with a cylindrical outer face 110G, an inner parabolic flat face 110F and internal flat face 110E. The two internal parabolic flat faces 110F of the body begin at the liner wing vertex 132A and 132B and end at wing arc ends 121A and 121B; faces 110F are symmetrical and parallel to each other, and perpendicular with the wing collapse plane that is centrally located and collinear with longitudinal axis 137 between the two flat faces 110F.

Flat faces 110F and faces 110E of the shaped charge body 110D help confine the wing HE 140A and 140B portion of HE billet 115 by providing cavity closure between the flat faces 110F and the liner parabolic faces 130A and 130B on each side of the wing-like extensions or flutes 125A and 125B of the EW liner 105. The body 110 preferably tapers or boat tails smaller in some manner toward the rearward end 110B from aft of the liner apex 108 toward the detonator holder 135 minimizing the overall mass of HE billet 115, reducing the amount of explosive by boat tailing body 110 increases the charge efficiency without affecting the liner collapse performance, and reduces unwanted collateral target damage from excessive explosive mass.

The invention described and depicted herein produces a two part stretching jet, the forward portion is a rod like asymmetric jet and the aft portion is spread into a sheet like planar symmetric shape reminiscent of the jetting of a linear shaped charge. In order to achieve the greatest jet length and penetration depth the jetting process of a shaped charge requires the liner material to reach a high temperature during collapse, which allows plastic flow of the collapsed liner material and produces a long stretching jet. Since jet length and penetration are directly proportional it is reasonable to make the greatest effort to provide the longest and most robust jet possible.

The above description of the directions of the shaped charge body and liner can be reversed whereby the axisymmetric jet is aft of the spade jet, there can be multiple sections alternating from axisymmetric and planar symmetric sections that produce alternating spade rod spade rod jet. The sections making up a liner do not have to have the same internal angle, thickness profile or material. The internal angles of these sections can vary from 36 degrees to 120 degrees and still produce Munroe jetting, that is to say a ductile jet having a velocity gradient from tip to tail. The arc length of each wing as encompassed by radial lines radiating from the central axis and intersecting each cord end of the arc of the wing can vary from 90 to 140 degrees.

FIG. 2, FIG. 2A, FIG. 2B, FIG. 2C, and FIG. 2D illustrate a EW liner 200 used in the device of the FIG. 1 embodiment, that consist of a apex 208 toward the aft end of the full circumference conical section "B" 222, and a partial circumference wing section "C" 233 with base ends 220A and 220B, liner wing extensions 225A and 225B, and wing base arc ends 221A and 221B toward the forward end of EW liner 200. The liner wing extensions 225A and 225B extend or protrude in a forward direction from section A 222 beginning at wing vertex 232A and 232B and ending at the base ends 220A and 220B. Wing vertex 232A and 232B are positioned longitudinally at vertical line 213 where the liner transitions from the full circumference conical section B 222 into a partial circumference conical or other shape wing section C 233. Liner wall 209 of section B 222 and section C 233 can vary in thickness, curvature, and included angle A can be increased or decreased to achieve desired rod and spade jet velocities and mass.

The conical section B 222 and wing section C 233 share a common longitudinal symmetrical axis 237, section C 233 also has a horizontal collapse plane 245 in the 3 to 9 o'clock position and vertical plane 246 in the 12 to 6 o'clock position they are perpendicular to each other and intersect each other at symmetrical axis 237. Section B 222 is axisymmetric or symmetrical about axis 237 in all radial planes for 360 degrees, whereas section C 233 has two parabolic faces 230A and 230B that are planar symmetric about vertical plane 246; and two extended wings 225A and 225B that are planar symmetric about horizontal plane 245 and also axisymmetric between the wing arc ends 221A and 221B about axis 237. The EW liner 200 is a modified hollow cone, but could also be other relative hollow shapes (i.e. hemisphere, trumpet, tulip), having two opposing equal sections removed at the base end of the liner, creating two extended wings like 225A and 225B and two parabolic faces like 230A and 230B.

The absence of the two opposing equal liner wall sections at the liner base end creates two equal 180 degree opposed liner wing extensions 225A and 225B or flutes. The included angle A of the hollow conical liner and the longitudinal length of the full section B 222 portion of the liner determines the longitudinal wing length from wing vertex 232A and 232B to the base end 220A and 220B of the extended wings 225A and 225B or fluted portions of the liner and thusly the amount of the liner wall 209 material that is dedicated to producing the spade or flattened portion of the jet. The longitudinal length of section B 222 and the extended wings 225A and 225B or flutes can be increased or decreased to achieve the desired ratio of rod to spade length of the jet created from EW liner 200. The thickness of the liner wall 209 can gradually increase or decrease from the apex 208 to the base end 220A and 220B or anywhere along the wall length; a tapering liner wall 209 thickness will help balance the liner to HE mass ratio as the liner cone diameter increases toward the base end 220A and 220B.

Liner thickness of shaped charges are dependent on the overall diameter of the device, the liner wall 209 should increase in thickness as the device diameter increases and decrease in thickness as the device diameter decreases. Shaped charges scale very nicely and for the person skilled in this art making this device in any size would be evident based on the information given. Shaped charges by their very nature have varying liner wall thicknesses and profiles depending on liner material type, liner density, the jet velocity required, and desired effect on a target. The winged exterior of the liner 200 is 216 and the full conical section of the liner 200 is 234. The EW liner 200 could be made from many profiles including cones, tulips, trumpets, hemispherical, etc. to accomplish desired effects on targets.

The axisymmetric wing extensions 225A and 225B curvature, section C 233 of the Axilinear liner wall 209 material support the convergence of material to create a high velocity flattened deep penetrating spade jet on horizontal plane 245. The axisymmetric curvature of the liner wings prevents the formation of a conventional planar symmetric "V" shaped low velocity linear shaped charge.

The combination of the hybrid axisymmetric and planar symmetric EW liner 200 used in a precision Axilinear shaped charge produces the necessary material convergence for a high velocity rod and spade shaped stretching jet above 4.0 km/s that is capable of producing deep hydrodynamic plastic target material penetrations from a much lower HE to liner mass ratio than a conventional linear shaped charge. The present invention avoids the problems associated with conventional linear shaped charges having large explosive to liner mass ratios; namely, the formation of low velocity (about 2.0 km/s) thin blade or ribbon jet that produce shallow target cuts (mostly non-plastic erosion much like water jet cutting) from "V" shaped planar symmetric liner walls.

The present invention is a high velocity precision shape charge, which can be distinguished from conventional linear charges that are non-precision low efficiency cutting charges, without axisymmetric radial convergence. Two types of shaped charges include an Axisymmetric shape charge and a Linear or planar symmetric. An axisymmetric shaped charge is basically a hollow cone or other similar shaped liner that is symmetric about a central longitudinal axis. Liners are usually made from copper, although it could be made of many other materials, having an explosive billet to which the outside of the liner is exactly mated.

A Linear shaped charge, sometimes referred to as a line charge, is essentially a V shaped straight hollow thin walled trough backed on the outside of the V by an appropriately shaped explosive mass. When detonated above the apex of the liner, this linear shaped charge produces sheet or ribbon-like jetting. The velocity from this type of shaped charge is in the 2-3 km/s range with little or no velocity gradient and consequent shorter jet and less penetration. The jetting occurring in this device is not Munroe jetting as the collapse is only two dimensional (does not have axisymmetric convergence) and does not reach the required temperature for plastic flow to take place. As a further recognition of the inefficiency of a conventional linear shaped charge, the detonation wave does not reach the full length of the liner apex simultaneously, this causes an undesirable dispersion of the resulting spray of liner material and no real continuity to the spray.

The jet produced by each Axilinear shaped charge in the present invention is a stretching combination of a rod and spade shaped like projectile having a velocity gradient from tip to tail, tip velocity of the this jet could be as high as 10 km/s depending on the included angle, charge to mass ratio, confinement, and shape of the liner, jet tail velocities are about 2 km/s. The present invention achieves higher velocity precision formation of an explosive jet without the need to increase the explosive mass, which would be required in the prior art conventional charge. The present invention is much more efficient and effective in that conventional linear charges cannot make precision deep target cuts or penetrations like the claimed invention because of their large HE to liner mass ratio, and typically, prior art shape charges produce a wide cratering effect from the collateral damage of the large amount of explosive which is avoided in the present invention.

When the EW liner 200 wing extensions 225A and 225B are collapsed to horizontal plane 245 the jet energy is spread longitudinally forward and laterally outward over a larger spade shaped area parallel to and centered on horizontal plane 245, and upon target impact forms a plastic flowing region of jet and target material, that produces an elongated slotted hole that is parallel with horizontal plane 245 in the target material.

Since the liner wing extensions 225A and 225B are not connected or confined on the two opposing sides with parabolic faces 230A and 230B, the collapse of the liner wing extensions 225A and 225B material will spread in the direction of no confinement producing a flat spade shaped jet that stretches longitudinally on axis 237 and widens laterally on horizontal plane 245; somewhat like a linear shaped charge, but at a much higher velocity and directionally controlled by horizontal plane 245 orientation about axis 237. The liner wall 209 transition at vertical line 213 from the axisymmetric section B 222 portion of the EW liner 200 to the remaining axisymmetric and planar symmetric section C 233 is gradual so as to maintain jet continuity between the rod and spade portions of the jet.

Axisymmetric shaped charge liners come in cone, hemispherical, trumpet, and tulip shapes, included liner angles from 30 to 120 degrees and almost any base diameter within manufacture capability, the hybrid axisymmetric planar symmetric or Axilinear liner disclosure in this patent application intends to include this wide variety of profiles as part and parcel of the claims of this application.

Figure 2:
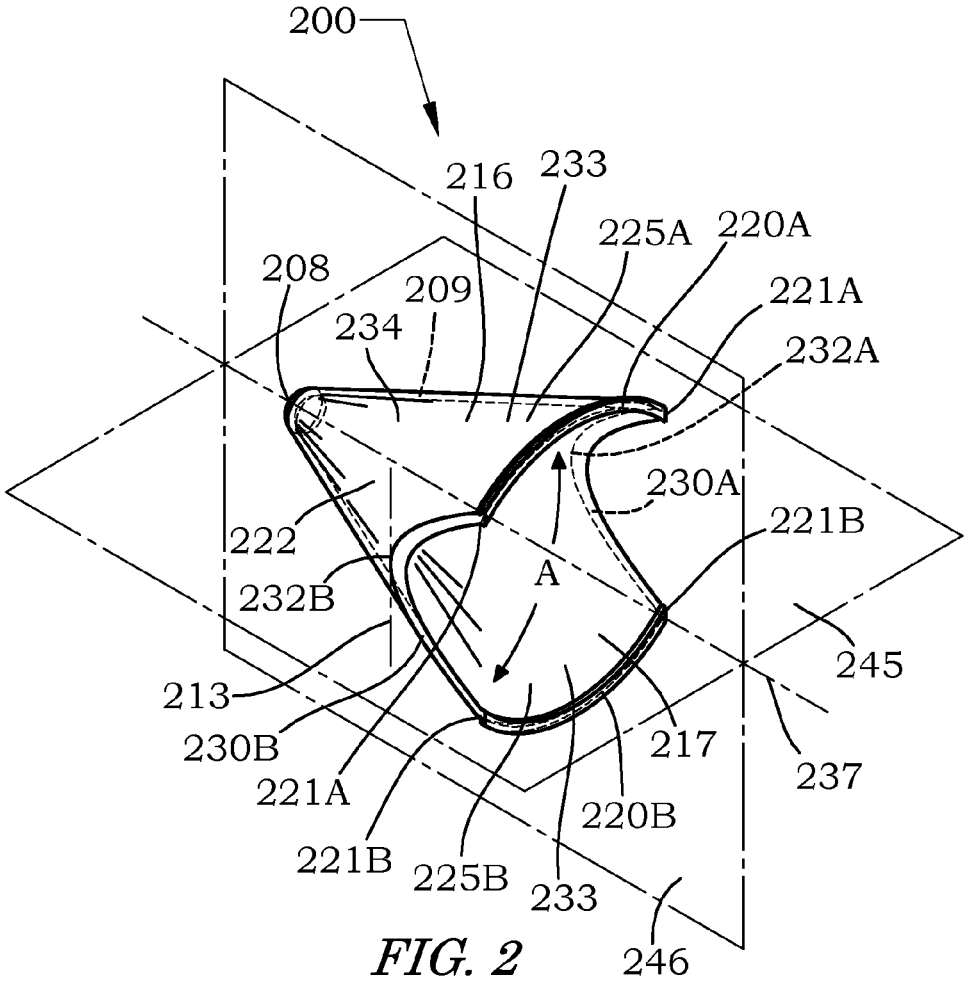
FIG. 2 is a perspective view of a single conical Axilinear extended wing liner used in the FIG. 1 embodiment.
Figure 2A:
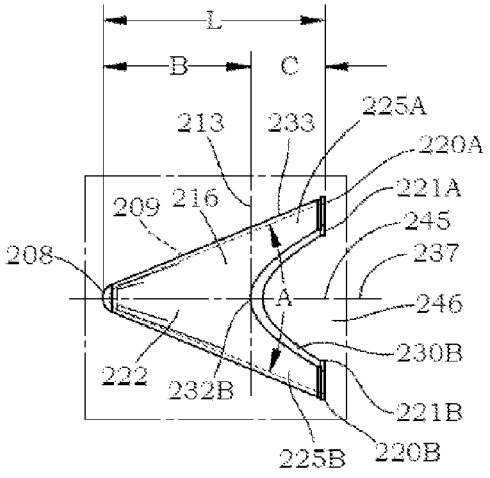
FIG. 2A-2B are elevation and end views of a single conical Axilinear extended wing liner used in the FIG. 1 embodiment illustrating the direction of reference planes relative to the liner wings.
Figure 2B:
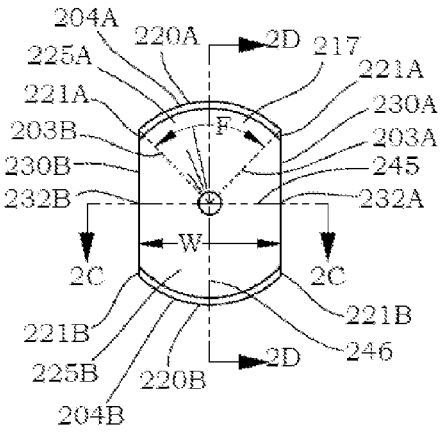
Figure 2C:
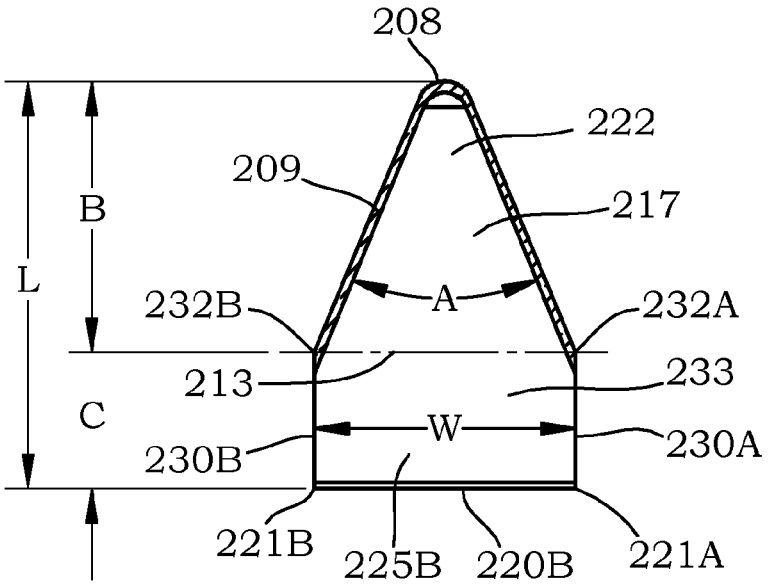
FIG. 2C is a sectional view along horizontal line 2C-2C in FIG. 2B of a single conical Axilinear extended wing liner used in the FIG. 1 embodiment that further illustrates the full and partial conical sections.
Figure 2D:
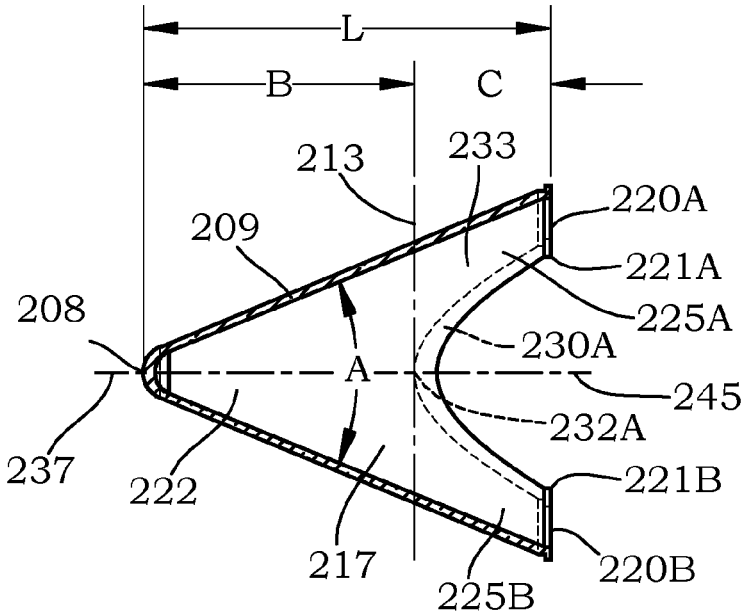
FIG. 2D is a sectional view along vertical line 2D-2D in FIG. 2B of a single conical Axilinear extended wing liner used in the FIG. 1 embodiment that further illustrates the full and partial conical sections.

For description purposes the Axilinear liner can be sectioned at vertical line 213 shown in FIG. 2A, FIG. 2C, and FIG. 2D, with an aft full circumference conical section "B" 222, and forward partial circumference wing section "C" 233, the aft section B 222, being a full circumference of one of, or combination of the liner profiles, cone, tulip, trumpet, hemispherical, or other. HE detonation pressures on the full conical section B 222 produces an axisymmetric rod like stretching jet with mass, length, stretch rate, velocity, and time of flight of the jet proportional to the length, included angle A, and liner wall 209 thickness of section B 222; and on impact produces a deep round target material penetration.

The forward section C 233 consists of two less than full circumference liner walls 209 extending beyond the end of section B 222, creating partial conical or curved wing extensions 225A and 225B, wing vertices 232A and 232B and parabolic faces 230A and 230B that are symmetrically one hundred and eighty degrees apart. The wing vertex 232A and 232B and flat parabolic faces 230A and 230B are formed from the absence of material on two symmetrically opposing sides of the base end of the conical profile.

The wing extensions 225A and 225B create an axisymmetric and planar symmetric opposing partial radial hollow concavities on the inside liner wall surface 217 as viewed from horizontal plane 245; HE detonation pressures on these concavities provides a partial radial convergence and work into the liner material to cause it to rise in temperature and ductility causing plastic flow and hydrodynamic jetting. The outer surface of liner 200 along the winged extension 216 is shown in FIG. 2, while the outer surface of the liner 200 in the full conical section 234 is also shown in FIG. 2.

The collapse of the wing extensions 225A and 225B of section C 233 produces a wide planar symmetric stretching non round spade shaped jet which cuts a deep slot rather than a round hole; the mass, width, length, stretch rate, velocity, and time of flight of the spade jet is directly proportional to the liner wall length of section C 233, included angle A, and liner wall 209 thickness of section C 233. If section C 233 is shortened and the overall length "L" is unchanged section B 222 will become longer. Increasing the length of section B 222 will increase the rod jet length, mass and penetration depth, and will decrease the length, width, mass and penetration depth of the spade jet; length adjustments to sections B and C work in concert, when the rod jet is lengthened the spade jet will be shortened and vice versa shortening the rod jet will lengthen the spade jet.

FIG. 2B is a base end view of liner 200 that further clarifies the liner construction and positions of the wing extensions 225A and 225B to the descriptive planes. FIG. 2B shows the wing extensions 225A and 225B at the 12 and 6 o'clock positions with a horizontal plane 245 dividing the distance between the two wings; and the flat parabolic faces 230A and 230B in the 3 and 9 o'clock positions with a vertical plane 246 dividing the distance between the two parabolic faces.

Wing width "W" represents the width from parabolic face 230A to face 230B, increasing the width W will make the wing arc length or distance between the wing arc endpoints 221A longer and angle F larger. Radial lines 203A and 203B that radiate from the central axis to each wing arc end point 221A of wing 225A illustrate the wing arc cord length 204A; the cord length can be increased or decreased by changing arc angle F. Arc angle F of the wings 225A and 225B can vary from 90 to 140 degrees but each wing on EW liner must have the same angle F and cord length 204A and 204B to have the symmetry needed for axisymmetric convergence of the wings.

FIG. 2C is a horizontal section view of EW liner 200 taken along line 2C-2C of FIG. 2B showing an elevated view of wing 225B and the inside liner surface 217, that further clarifies the profile of section B 222 with included angle A and section C 233 with wing width W. If width W increases and angle A and the overall length L is held constant the length of section C 233 and the extended wings will become shorter, the horizontal line 213 will move toward base end 220B and the length of section B 222 will become longer which will increase the length of the rod jet. Changing the length of section C 233 and section B 222 will change the length ratio of rod to spade jet. To improve the liner to HE mass ratio and rod jet performance liner wall thickness 209 may be held constant or can taper by increasing or decreasing the wall thickness 209 from apex 208 to wing vertex 232A and 232B.

FIG. 2D is a vertical section of EW liner taken along line 2D-2D of FIG. 2B showing an elevated view of the inside liner surface 217 and parabolic face 230A that further clarifies the profile of conical section B 222 and wing section C 233 with included angle A. Conical section B 222 and wing section C 233 have the same included angle A, and if angle A and the overall length L is held constant and the length of wing section C 233 increases, the vertical line 213 will move toward apex 208, which will increase the length of the spade jet and will decrease the length of the rod jet and vice versa if section C becomes shorter the spade jet length will decrease and the rod jet will increase. To improve the liner to HE mass ratio and spade jet performance, liner wall thickness 209 may be held constant or can taper by increasing or decreasing the wall thickness 209 from apex 208 to wing base end 220A and 220B.

Figure 3:
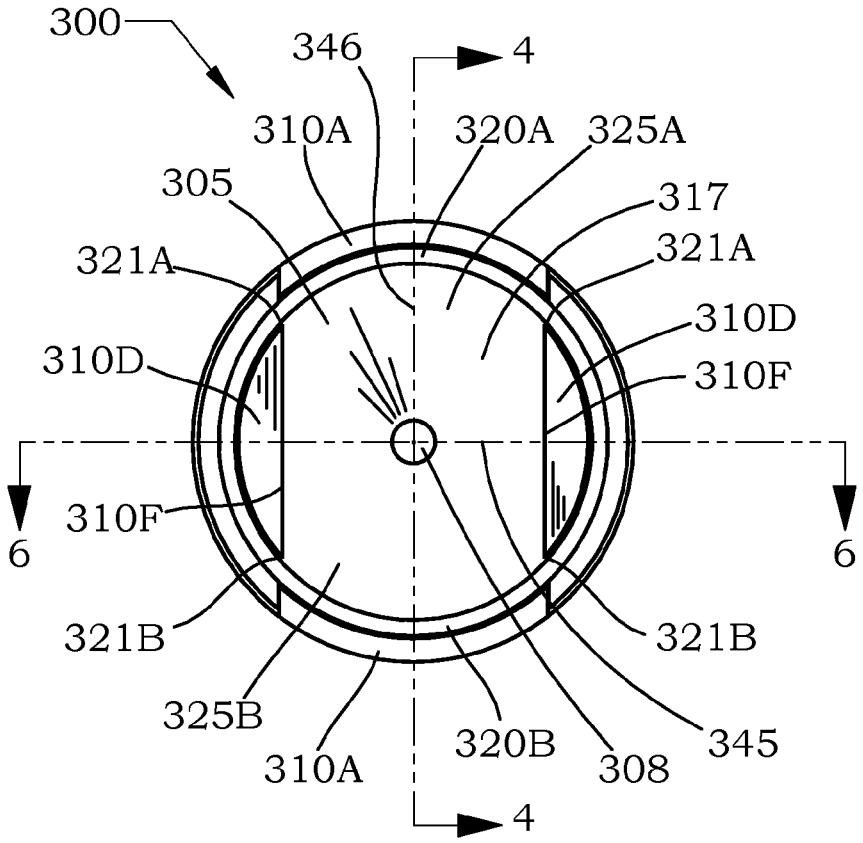
FIG. 3 is an end view of the embodiment shown in FIG. 1 illustrating the liner wings in the 12 and 6 o'clock positions.

FIG. 3 is an end view of the Axilinear shaped charge device of the FIG. 1 embodiment, which shows the orientation of the EW liner 305 wing extensions 325A and 325B in the 12 and 6 o'clock position with a vertical plane 346 and a horizontal wing collapse plane 345. An apex 308 with base ends 320A and 320B, liner wing extensions 325A and 325B, and wing base arc ends 321A and 321B toward the forward end of EW liner 300. The liner wing extensions 325A and 325B extend or protrude in a forward direction from section A beginning at wing vertex and ending at the base ends 320A and 320B. Wing vertex is positioned longitudinally where the liner transitions from the full circumference conical section B into a partial circumference conical or other shape wing section C. Liner wall of section B and section C can vary in thickness, curvature, and included angle A can be increased or decreased to achieve desired rod and spade jet velocities and mass.

The conical section B and wing section C 333 share a common longitudinal symmetrical axis, section C also has a horizontal collapse plane 345 in the 3 to 9 o'clock position and vertical plane 346 in the 12 to 6 o'clock position they are perpendicular to each other and intersect each other at symmetrical axis. Section B is axisymmetric or symmetrical about axis 337 in all radial planes for 360 degrees, whereas section C has two parabolic faces that are planar symmetric about vertical plane 346; and two extended wings 325A and 325B that are planar symmetric about horizontal plane 345 and also axisymmetric between the wing arc ends 321A and 321B about axis 337. The EW liner 300 is a modified hollow cone, but could also be hemisphere, trumpet, tulip shapes, each having two opposing equal sections removed at the base end of the liner, creating two extended wings like 325A and 325B and two parabolic faces like 310F and 310F.

The absence of the two opposing equal liner wall sections at the liner base end creates two equal 180 degree opposed liner wing extensions 325A and 325B or flutes. The included angle A of the hollow conical liner and the longitudinal length of the full section B portion of the liner determines the longitudinal wing length from wing vertex A to the base end 320A and 320B of the extended wings 325A and 325B or fluted portions of the liner and thusly the amount of the liner wall material that is dedicated to producing the spade or flattened portion of the jet. The longitudinal length of section B and the extended wings 325A and 325B or flutes can be increased or decreased to achieve the desired ratio of rod to spade length of the jet created from EW liner 300. The thickness of the liner wall can gradually increase or decrease from the apex 308 to the base end 320A and 320B or anywhere along the wall length; a tapering liner wall thickness will help balance the liner to HE mass ratio as the liner cone diameter increases toward the base end 220A and 220B.

EW liner 305 has a liner wall thickness that can remain constant or gradually decrease in thickness from the aft apex 308 to the base end 320A and 320B. The charge body 310 has two flat faced parabolic sides 310F in the 9 and 3 o'clock position that have parabolic faces that geometrically match the EW liner 305 parabolic faces 330A and 330B, when coupled together these faces make a tight fitting body and liner coupling that supports the EW liner 305 wings and serves as containment for HE billet 315 along the partial circumference portion of EW liner 305. There is no HE or EW liner 305 material confinement laterally outside of the two parabolic sides 310F.

After the collapse of full conical section B by HE section B into a rod jet the curved wing-like extensions or flutes 325A and 325B of wing section C 333 are driven to horizontal plane 345 and symmetrical axis 337 of the EW liner 305 by the HE section C with wing explosive 340A and 340B, the colliding material forms a flat blade shape jet instead of a round jet because of the lack of liner material and HE confinement on the flat faced sides 310F that are ninety degrees out of phase from the wing-like extensions or flutes 325A and 325B. The transition from conical section B to wing section C is gradual which allows the spade jet to stay connected to the forward rod jet as both portions of the jet stretch longitudinally forward along axis 337; and because of the lack of liner confinement on the two opposing parabolic faces 310F the spade jet will widen laterally on horizontal plane 345 as it stretches longitudinally forward with the forward rod jet. The body area 310D at the forward end of cylindrical section 310A that transitions from a cylindrical shape into two parallel flat parabolic faces 310F that are planar symmetric to each other and are coupled to the parabolic liner faces.

Figure 3A:
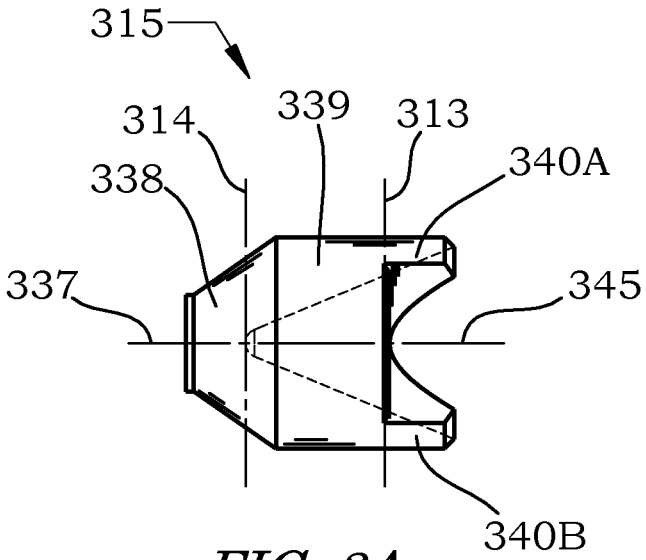
FIG. 3A-3B are elevation views of the high explosive billet used in the FIG. 1 embodiment.
Figure 3B:
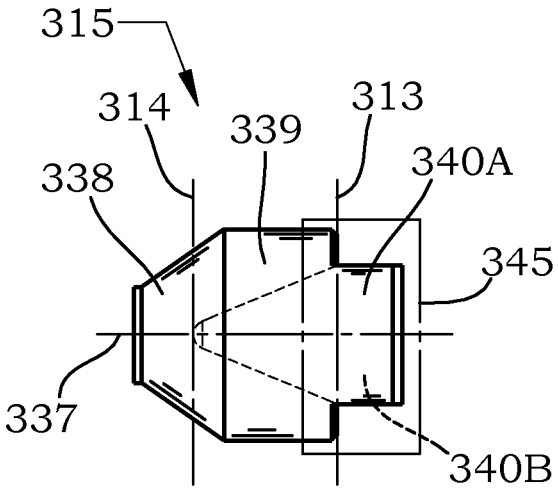
Figure 4:
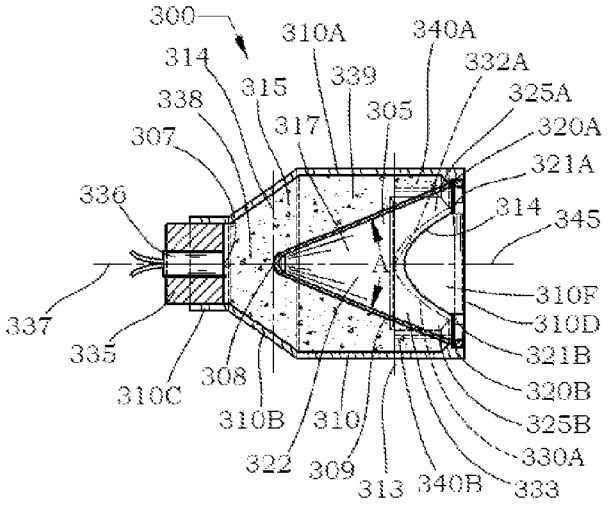
FIG. 4 is a sectional view along vertical line 4-4 in FIG. 3 that is perpendicular to the horizontal collapse plane of the liner wings, of the Axilinear shaped charge embodiment of FIG. 1.
Figure 6:
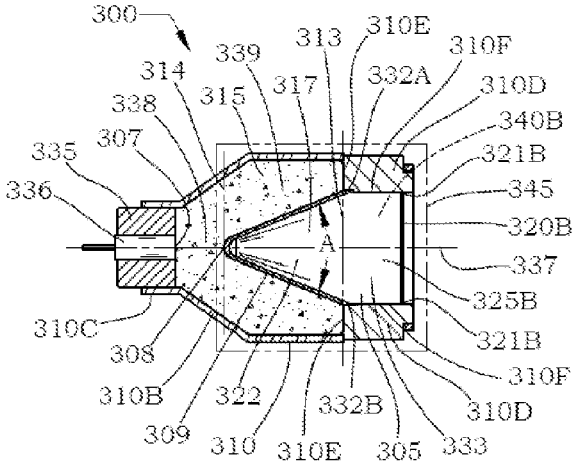
FIG. 6 is a sectional view along horizontal line 6-6 in FIG. 3 that is coplanar to the horizontal collapse plane of the liner wings, of the Axilinear shaped charge embodiment of FIG. 1.

FIG. 3A and FIG. 3B further clarify the shape and orientation of HE billet 315 of the FIG. 3 embodiment and as shown in FIG. 4 and FIG. 6, respectively. The orientation of HE 315, axis 337 and horizontal plane 345 in FIG. 3A being the same as in FIG. 4; with the aft head height HE section "A" 338 and forward vertical line 314, full circumference conical HE section "B" 339 being located between aft vertical line 314 forward vertical line 313, and HE section "C" with wing explosive 340A and 340B forward of vertical line 313. The orientation of HE 315, axis 337 and horizontal plane 345 in FIG. 3B being the same as in FIG. 6; with the aft head height HE section A 338 and forward vertical line 314, full circumference conical HE section B 339 located between aft vertical line 314 and forward vertical line 313, and HE section C with wing explosive 340A and 340B forward of vertical line 313.

Vertical line 313 and 314 of FIG. 3A and FIG. 3B share the same longitudinal position with 313 and 314 as FIG. 4 and FIG. 6. Vertical line 314 is located longitudinally at apex 308 of FIG. 4 and FIG. 6, and vertical line 313 is longitudinally located at wing vertex of FIG. 4 and FIG. 6. FIG. 4 is a vertical sectional view taken along line 4-4 of FIG. 3 that extends from the aft end detonator holder 336 through the fore radial midpoint of the wing-like extensions or flutes 325A and 325B at the base end 320A and 320B of EW liner 305 with an elevated view of parabolic flat face 310F.

The lateral cross section of FIG. 4 along line 4-4 is coincident with Axilinear device 300 symmetrical axis 337, and extends perpendicular to the horizontal plane 345, which is also coincident with axis 337 and equidistant from the wing-like extensions or flutes 325A and 325B. EW liner 305 has a liner wall thickness that can remain constant or gradually decrease in thickness from the aft apex 308 to the base end 320A and 320B. The charge body 310 has two flat faced parabolic sides 310F in the 9 and 3 o'clock position that have parabolic faces that geometrically match the EW liner 305 parabolic faces 330A and 330B, when coupled together these faces make a tight fitting body and liner coupling that supports the EW liner 305 wings and serves as containment for HE billet 315 along the partial circumference portion of EW liner 305. There is no HE or EW liner 305 material confinement laterally outside of the two parabolic sides 310F.

As shown in FIG. 4, the Axilinear shaped charge device 300 consists of a body 310, EW liner 305, high explosive (HE) billet 315, having an axisymmetric aft area with detonator 336, detonator holder 335, detonation initiation point 307, and liner apex 308, and a axisymmetric as well as planar symmetric (Axilinear) fore area that consists of liner extended wings 325A and 325B and liner base ends 320A and 320B. Initiation of the HE billet of this novel device can be achieved by any suitable readily available detonation initiation devices.

Device 300 is axisymmetric or symmetrical about a longitudinal axis 337 from the aft end near detonator 336 to the middle liner wing vertex 332A and 332B of the EW liner 305; forward of wing vertex 332A and 332B device 300 is Axilinear with two symmetrical curved extended wings 325A and 325B being axisymmetric with axis 337 and also planar symmetric about two central perpendicular reference planes, a horizontal plane in the 3 and 9 o'clock positions, and a vertical plane in the 12 and 6 o'clock positions.

Vertical line 313 and 314 of FIG. 3B and FIG. 3B share the same longitudinal position with vertical line 313 and 314 in FIG. 4 and FIG. 6. Vertical line 314 is located longitudinally at apex 308 of FIG. 4 and FIG. 6, and vertical line 313 is longitudinally located at wing vertex of FIG. 4 and FIG. 6. The vertical 12 and 6 o'clock reference plane (FIG. 2 vertical plane 246) is coincident with axis 337 and passes through the middle of each extended wing 325A and 325B, the parabolic faces 330A and 330B are planar symmetric or mirrored about this plane. The horizontal 3 and 9 o'clock reference plane (FIG. 2 horizontal collapse plane 245) is coincident with axis 337 and passes through each wing vertex 332A and 332B, this plane is also known as the wing collapse plane and the wings 325A and 325B are planar symmetric or mirrored about this plane. The jet produced by detonating an Axilinear shaped charge device 300 is axisymmetric for the forward rod portion of the jet and planar symmetric for the aft portion, this aft spade portion of the jet being shaped somewhat like a linear shaped charge jet, thusly named Axilinear.

The Axilinear shaped charge device 300 is shown with a conical EW liner 305, other geometrical shaped (i.e. hemispherical, tulip, or trumpet) hollow cavity formed liners with extended liner wings can also be used. EW liner 305 has a full circumference axisymmetric conical profile section 322 with included angle A that is longitudinally between aft apex 308 and middle liner wing vertex 332A and 332B, and a Axilinear partial circumference wing section 333 toward the fore end with two symmetrically opposing conical fluted wing extensions 325*a* and 325B with included angle A that extend longitudinally from the middle liner wing vertex 332A and 332B to the forward liner base ends 320A and 320B.

The forward liner wing extensions 325A and 325B are symmetrical to each other and positioned one hundred and eighty degrees apart, opposing each other planar symmetrically about the horizontal plane and is axisymmetric about longitudinal axis 337 of the device. The absence of liner wall material on opposing sides of the wing section 333 at the forward base end of the liner forms two parabolic faces 330A and 330B that are parallel and symmetric with each other about longitudinal axis 337 and the vertical plane. Both liner parabolic faces 330A and 330B have a vertex at wing vertex 332A and 332B and open toward the base ends 320A and 320B with parabolic end points at the wing arc ends 321A and 321B.

EW liner 305 maintains its conical profile and liner wall 309 thickness profile from aft end apex 308 of the full circumference conical section 322 to wing vertex 332 and continues with the same profile to the fore end of the extended wings 325A and 325B at the base ends 320A and 320B of the partial circumference wing section 333. Liner wall 309 transitions from a full circumference conical profile at wing vertex 332A and 332 B into 180 degree symmetrically opposing wing like or fluted extensions 325A and 325B that extend from the full circumference conical profile section 322 at wing vertex 332A and 332B to the base end 320A and 320B of the liner.

The liner wing extensions 325A and 325B shown in FIG. 4 retain the same curvature, included angle A, and wall 309 thickness profile as the full conical profile section 322 portion of the liner; but the extended wings 325A and 325B could also have a larger or smaller included angle A and wall thickness 309 than the conical section 322, as long as they maintain planar symmetry to one another. Being planar symmetric and having partial circumference conical curvature allows the wing-like extensions or flutes 325A and 325B to converge at very high pressures on the collapse plane, raising the temperature and ductility of the converging wing material to the required level for Munroe jetting.

HE billet 315 can be pressed, cast or hand packed from any commercially available high order explosive. HE billet 315 is in intimate contact with the outer liner surface 316 of EW liner 305 from the aft apex 308 to the forward wing vertex 332A and 332B of the conical profile section 322 and from the wing vertex 332A and 332B to the base ends 320A and 320B and wing arc ends 321A and 321B of the wing section 333. HE billet 315 has three distinct sections, a head height or aft HE section "A" 338 as measured longitudinally between HE initiation point 307 and liner apex 308, a mid-section or full conic HE section "B" 339 as measured longitudinally from apex 308 to wing vertex 332A and 332B, that fully encompasses the liner conical section 322, and forward HE section "C" that contains two partial circumference wing HE sections 340A and 340B as measured longitudinally from wing vertex 332A and 332B to base ends 320A and 320B that conform to the shape of the liner wing extensions 325A and 325B.

HE section A 338 can be lengthened or shortened longitudinally by increasing or decreasing the length of body 310, greater head height gives a flatter detonation wave before it comes in contact with the liner. Flatter detonation waves at time of liner impact typically increase jet tip velocity and target penetration, head height optimization is a balance between jet performance and minimizing the explosive charge. The optimum head height can be determined by computer code and live testing to obtain the least amount HE volume needed to efficiently obtain maximum jet mass, velocity and target penetration. A typical head height for a conical lined shaped charge would be ½ inch space permitting.

The shape and volume of HE section B 139 is defined by the area between the inside surface 312 of body 310 and outside surface 316 of EW liner 305 from aft apex 308 to forward body face 310E located at wing vertex 332A and 332B, and makes a full circumference or revolution around liner section 322. The shape and volume of the two symmetrical wing HE sections 340A and 340B of HE section C 340 are defined by the area between the inside surface 312 of body 310 and outside surface 316 of EW liner 305 from aft wing vertex 332A and 332B to forward base ends 320A and 320B, and are partial circumference volumes about each wing between the wing arc end points 321A and 321B. HE billet 315 can have a super-caliber diameter (i.e. larger than the liner base diameter) necessary for full convergence of the base end of the liner wing extensions 325A and 325B to obtain maximum velocity and mass of the spade jet.

The forward section C 333 consists of two less than full circumference liner walls 309 extending beyond the end of section B 322, creating partial conical or curved wing extensions 325A and 325B, wing vertices 332A and 332B and parabolic faces 330A and 330B that are symmetrically one hundred and eighty degrees apart. The wing vertex 332A and 332B and flat parabolic faces 330A and 330B are formed from the absence of material on two symmetrically opposing sides of the base end of the conical profile. Wing arc ends 321A and 321B are parabolic end points on the forward edge of liner 305.

The wing extensions 325A and 325B create an axisymmetric and planar symmetric opposing partial radial hollow concavities on the inside liner wall surface 317; HE detonation pressures on these concavities provides a partial radial convergence and work into the liner material to cause it to rise in temperature and ductility causing plastic flow and hydrodynamic jetting.

The collapse of the wing extensions 325A and 325B of section C 333 produces a wide planar symmetric stretching non round spade shaped jet which cuts a deep slot rather than a round hole; the mass, width, length, stretch rate, velocity, and time of flight of the spade jet is directly proportional to the liner wall length of section C 333, included angle A, and liner wall 309 thickness of section C 333. If section C 333 is shortened and the overall length "L" is unchanged section B 322 will become longer. Increasing the length of section B 322 will increase the rod jet length, mass and penetration depth, and will decrease the length, width, mass and penetration depth of the spade jet; length adjustments to sections B and C work in concert, when the rod jet is lengthened the spade jet will be shortened and vice versa shortening the rod jet will lengthen the spade jet.

During collapse of the liner full conical section 322, liner material radially converges along the longitudinal axis 337 into a rod jet from the detonation of HE section A 338 and HE section B 339; the collapse of full conical section 322 is followed by the collapse of the extended liner wings 325A and 325B of the partial circumference section 333 into a spade jet from the detonation of wing HE sections 340A and 340B of HE section C. Wing HE sections 340A and 340B are coupled to the outer liner surface 316 of each wing from the aft wing vertex 332A and 332B to the forward wing base ends 320A and 320B and the wing arc ends 321A to 321B.

The radial curvature of the opposing liner wing extensions 325A and 325B provides the radial material convergence during collapse needed to raise the temperature and pressure of the collapsed liner material, to the required level for plastic flow and Monroe jetting to occur, this increases the ductility allowing for longer jet breakup length. During collapse, the full conical section 322 of the liner will form a axisymmetric rod jet along the longitudinal axis 337 followed by the concave liner wing extensions 325A and 325B being driven to a common collapse plane by HE 340A and 340B, the colliding wing extensions material will form into a high velocity flat planar symmetric spade shape jet.

As the collapsed wing extensions material moves forward along longitudinal axis 337 it also spreads laterally outward forming the spade shaped jet along the horizontal collapse plane. The formation of the spade jet is due to the absence of liner material, explosive and confinement on the liner sides with the two flat parabolic faces 330A and 330B that are adjacent to and ninety degrees out of phase from the flutes or wing extensions 325A and 325B. The orientation of device 300 can be rotated about axis 337 and the spade jet orientation will rotate equally in the same direction, if device 300 is rotated 45 degrees clockwise about axis 337 the collapse plane will also rotate 45 degrees clockwise and the spade jet will stretch longitudinally forward on axis 337 and laterally along the rotated collapse plane.

The EW liner 305 is the working material of the shaped charge and is mounted to body 310 at the forward end of device 300, at the base ends 320A and 320B of the liner wing extensions 325A and 325B; and adjacent to the wings the liner parabolic faces 330A and 330B are mounted to the body 310 parabolic faces 310F. Body 310 consist of four distinct areas, a aft cylindrical area 310C that provides mounting for an initiation device that is coupled to the aft end of HE 315, followed by a boat tailed area 310B that contains the HE section A 338, followed by cylindrical area 310A that contains HE section B 339 that is coupled to the full conical liner section 322; and HE section C containing wing sections 340A and 304B that are coupled to the extended wings of liner section 333, and body area 310D at the forward end of cylindrical section 310A that transitions from a cylindrical shape into two parallel flat parabolic faces 310F that are planar symmetric to each other and are coupled to the parabolic liner faces 330A and 330B.

Body area 310D has two functions, it provides two opposing side mounting faces 310F for the liner extended wings and also has flat faces 310E that is the forward containment boundary of HE section 339; this boundary is located at wing vertex 332A and 332B, and is also the liner wing transition point from the full circumference conical section 322 to the extended wing section 333. The containment of HE pressures during the detonation time period by body area 310D is important for proper collapse of the wings and spade jet formation. Shape charge liners for the most part are made from copper but liners may be made from most any metal, ceramic, powdered metals, tungsten, silver, copper, glass or combination of many materials. Body 310 would typically be made from aluminum or steel but could be made of almost any metal or plastic as long as it provides the correct amount of tamping for proper jet formation and desired jet velocity during the detonation of HE billet 315.

The EW liner 305 is a modified cone or other shape with two distinct geometrical sections, the aft end of the liner is a full conical profile section 322 with an apex 308, followed by the forward end wing section 333 with two liner wing extensions 325A and 325B that extend forward from the full conical or other shape profile section 322 at wing vertex 332A and 332B to the wing base ends 320A and 320B at the fore end of EW liner 305. The liner wing extensions 325A and 325B maintain the same included angle A liner wall 309 thickness profile and curvature of the full conical profile section 322.

The included angle A of EW liner 305 needed to obtain Munroe effect jetting should be from 36 to 120 degrees. The jet velocity achieved from a shaped charge is dependent on the liner wall 309 thickness and included angle A of the liner; a narrower included angle results in a faster less massive jet, and a wider included angle results in a slower more massive jet. Jet velocities can vary from 4 to 10 km/s depending on the type and quality of liner material, included angle A of the liner, liner wall 309 thickness, the charge to mass ratio of HE to liner, bulk density of the liner, surface finish of the liner wall, and body geometries; very small changes of any of these variables can make large differences in jet velocity and trajectory.

The HE billet 315 is contained between the inner surface 312 of body 310 and the outer surface 316 of the EW liner 305. HE billet 315 provides the energy to collapse the EW liner 305, increasing the ductility of the EW liner 305 material, causing it to form a compound jet in the shape of a very high speed rod jet from the full conical section 322 material followed by a flattened spade shaped jet from the liner wing section 333 material; the spade jet is slower than the rod jet from conical section 322 but much faster than a typical "V" shaped liner found in common linear shaped charge because of the cavity of the wing section 333.

Body 310 provides a mounting surface for EW liner 305 which is held to body 310 at the liner base ends 320A and 320B and at the parabolic faces 330A and 330B. The base end of EW liner 305 does not form a full circumference; it consists of two opposing concave surfaces or wing extensions 325A and 325B and the corresponding wing base ends 320A and 320B at the forward end of the liner. Body 310 also serves as a containment vessel for the delicate HE billet 315 and protects it from damage or impact by supporting the outer diameter of HE billet 315. Body 310 also provides tamping for the HE billet 315 depending on body wall 306 thickness and material density, HE tamping can be increased or decreased if needed to improve jet performance or reduce total HE mass.

The purpose of removing the base end material on symmetrically opposing sides of EW liner 305 and creating the wing-like extensions 325A and 325B is twofold. The first purpose is to form the partial circumference conical wing-like extensions or flutes 325A and 325B and when collapsed converge to form the flat aft spade shaped portion of the jet; the flattened spade jet spreads laterally and erodes an elongated slot in target material. The second purpose being to allow for close lateral proximity of multiple adjacent devices resulting in multiple tightly spaced rod and intersecting spade jet perforations, creating a large coupled slotted target perforation.

Since the EW liner 305 material is not being confined along the two removed portions of the liner at parabolic faces 330A and 330B, the collapse of the wing-like extensions or flutes 325A and 325B will produce a flat jet, much like a linear shaped charge, but at a much higher velocity, stretching laterally and longitudinally. The transition from the conical profile section 322 to the remaining wing-like extensions or flutes 325A and 325B of EW liner 305 is very gradual so as to maintain continuity between the rod and spade portions of the jet.

The shaped charge body 310 has a frustoconical or boat tailed portion 310B near the aft end of the shaped charge device 300 that begins at detonator holder 335 and increases in diameter longitudinally to about the apex 308 of EW liner 305. The cylindrical portion 310A of the body 310 begins at about the apex 308 of the EW liner 305 and extends longitudinally to the forward end of device 300. The forward end of cylindrical portion 310A has two planar symmetrical 310D portions, each with a cylindrical outer face 310G, an inner parabolic flat face 310F and internal flat face 310E. The two internal parabolic flat faces 310F of the body begin at the liner wing vertex 332A and 332B and end at wing arc ends 321A and 321B; faces 310F are symmetrical and parallel to each other, and perpendicular with the wing collapse plane that is centrally located and collinear with longitudinal axis 337 between the two flat faces 310F.

Flat faces 310F and faces 310E of the shaped charge body 310D help confine the wing HE 340A and 340B portion of HE billet 315 by providing cavity closure between the flat faces 310F and the liner parabolic faces 330A and 330B on each side of the wing-like extensions or flutes 325A and 325B of the EW liner 305. The body 310 preferably tapers or boat tails smaller in some manner toward the rearward end 310B from aft of the liner apex 308 toward the detonator holder 335 minimizing the overall mass of HE billet 315, reducing the amount of explosive by boat tailing body 310 increases the charge efficiency without affecting the liner collapse performance, and reduces unwanted collateral target damage from excessive explosive mass.

The invention described and depicted herein produces a two part stretching jet, the forward portion is a rod like asymmetric jet and the aft portion is spread into a sheet like planar symmetric shape reminiscent of the jetting of a linear shaped charge. In order to achieve the greatest jet length and penetration depth the jetting process of a shaped charge requires the liner material to reach a high temperature during collapse, which allows plastic flow of the collapsed liner material and produces a long stretching jet. Since jet length and penetration are directly proportional it is reasonable to make the greatest effort to provide the longest and most robust jet possible.

The above description of the directions of the shaped charge body and liner can be reversed whereby the axisymmetric jet is aft of the spade jet, there can be multiple sections alternating from axisymmetric and planar symmetric sections that produce alternating spade rod spade rod jet. The sections making up a liner do not have to have the same internal angle, thickness profile or material. The internal angles of these sections can vary from 36 degrees to 120 degrees and still produce Munroe jetting, that is to say a ductile jet having a velocity gradient from tip to tail. The arc length of each wing as encompassed by radial lines radiating from the central axis and intersecting each cord end of the arc of the wing can vary from 90 to 140 degrees.

An apex 308 toward the aft end of the full circumference conical section "B" 322, and a partial circumference wing section "C" 333 with base ends 320A and 320B, liner wing extensions 325A and 325B, and wing base arc ends 321A and 321B toward the forward end of EW liner 300. The liner wing extensions 325A and 325B extend or protrude in a forward direction from section A 322 beginning at wing vertex 332A and 332B and ending at the base ends 320A and 320B. Wing vertex 332A and 332B are positioned longitudinally at vertical line 313 where the liner transitions from the full circumference conical section B 322 into a partial circumference conical or other shape wing section C 333. Liner wall 309 of section B 322 and section C 333 can vary in thickness, curvature, and included angle A can be increased or decreased to achieve desired rod and spade jet velocities and mass.

The conical section B 322 and wing section C 333 share a common longitudinal symmetrical axis 337, section C 333 also has a horizontal collapse plane 345 in the 3 to 9 o'clock position and vertical plane 346 in the 12 to 6 o'clock position they are perpendicular to each other and intersect each other at symmetrical axis 337. Section B 322 is axisymmetric or symmetrical about axis 337 in all radial planes for 360 degrees, whereas section C 333 has two parabolic faces 330A and 330B that are planar symmetric about vertical plane 346; and two extended wings 325A and 325B that are planar symmetric about horizontal plane 345 and also axisymmetric between the wing arc ends 321A and 321B about axis 337. The EW liner 300 is a modified hollow cone, but could also be other relative hollow shapes (i.e. hemisphere, trumpet, tulip), having two opposing equal sections removed at the base end of the liner, creating two extended wings like 325A and 325B and two parabolic faces like 330A and 330B.

The absence of the two opposing equal liner wall sections at the liner base end creates two equal 180 degree opposed liner wing extensions 325A and 325B or flutes. The included angle A of the hollow conical liner and the longitudinal length of the full section B 322 portion of the liner determines the longitudinal wing length from wing vertex 332A and 332B to the base end 320A and 320B of the extended wings 325A and 325B or fluted portions of the liner and thusly the amount of the liner wall 309 material that is dedicated to producing the spade or flattened portion of the jet. The longitudinal length of section B 322 and the extended wings 325A and 325B or flutes can be increased or decreased to achieve the desired ratio of rod to spade length of the jet created from EW liner 300. The thickness of the liner wall 309 can gradually increase or decrease from the apex 308 to the base end 320A and 320B or anywhere along the wall length; a tapering liner wall 309 thickness will help balance the liner to HE mass ratio as the liner cone diameter increases toward the base end 320A and 320B.

After the collapse of full conical section B 322 by HE section B into a rod jet the curved wing-like extensions or flutes 325A and 325B of wing section C 333 are driven to horizontal plane 345 and symmetrical axis 337 of the EW liner 305 by the HE section C with wing explosive 340A and 340B, the colliding material forms a flat blade shape jet instead of a round jet because of the lack of liner material and HE confinement on the flat faced sides 310F that are ninety degrees out of phase from the wing-like extensions or flutes 325A and 325B. The transition from conical section B 322 to wing section C 333 is gradual which allows the spade jet to stay connected to the forward rod jet as both portions of the jet stretch longitudinally forward along axis 337; and because of the lack of liner confinement on the two opposing parabolic faces 310F the spade jet will widen laterally on horizontal plane 345 as it stretches longitudinally forward with the forward rod jet.

Figure 5:
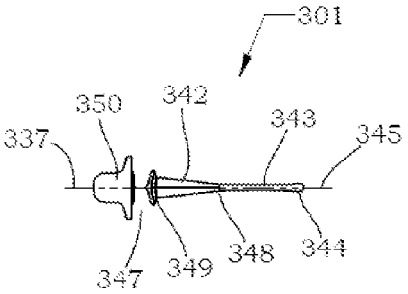
FIG. 5 is a view of the jet formed by the device embodiment of FIG. 1 that illustrates the orientation of the spade jet with respect to the liner wings of FIG. 4.

The horizontal plane 345 of the wing section C 333 is seen as a horizontal longitudinal line that is coincident with symmetrical axis 337 in FIG. 4. Horizontal plane 345 is where the liner material of the two 180 degree opposing extended axisymmetric and planar symmetric wing extensions 325A and 325B of EW liner 305 will converge from the detonation pressures of HE section C with wing explosive 340A and 340B forming the spade jet 342 shown in FIG. 5. Horizontal plane 345 also represents the orientation and direction of the wide lateral cross-section of spade jet 342, which are coplanar and coincident to each other. The liner wing extensions 325 of FIG. 4 and the view of jet 301 of FIG. 5 are correctly oriented to each other to represent the collapse of the EW liner 305 from this viewpoint, the spade jet 342 is seen as a thin section along symmetrical axis 337 and horizontal plane 345 that decreases in thickness from the aft end spade jet tail 349 to the forward end rod/spade transition point 348 where it is connected to the aft end of rod jet 343. Jet 301 would form within the hollow cavity of EW liner 305 of device 300 and at some time after liner collapse would eventually stretch past the base end 325A and 325B, it is shown in FIG. 5 fully outside of and to the right of the device for easier viewing.

Body 310 contains and protects HE billet 315 and provides a mounting surface for EW liner 305 at its base ends 320A and 320B. The HE billet 315 detonation is initiated by any suitable commercially available detonator 336 on the device symmetrical axis 337 at initiation point 307. With respect to the longitudinal symmetrical axis 337 of device 300, the liner full circumference conical section B 322 is aft of wing vertex 332A and the liner wing section C 333 is forward of the wing vertex 332A. The jet 301 produced by device 300 has three distinct regions and shapes; a high velocity 7-9 km/s round axisymmetric rod jet 343 with forward jet tip 344 and aft rod/spade jet transition point 348, followed by a lower velocity 4-7 km/s planar symmetric flattened spade jet 342 mid-section and jet tail 349, followed by the slug separation area 347 and a low velocity ½ km/s slug 350.

The forward axisymmetric rod jet 343 in FIG. 5 is formed from the conical section B 322 of EW liner 305 that starts at apex 308 and ends at the wing vertex 332A of the parabolic flat face 330A. At wing vertex 332A the conical section B 322 of the liner transitions into the wing section C 333 with two opposing concave liner wing extensions 325A and 325B or flutes, formed due to the liner side truncation. The aft spade jet 342 is formed from the collapse of the liner wing section C 333 opposing liner wing extensions 325A and 325B portions of EW liner 305. The aft spade jet 342 being flat and wide, similar to a conventional linear shaped charge jet but more massive, directionally controllable and at a much higher velocity, thus the Axilinear name. The amount of liner material designated to the aft and forward portions of the combination spade and rod jet can be adjusted by shortening or lengthening conical section B 322 and wing section C 333 of EW liner 305 to give differing lengths and widths of rod and spade shaped jet sections.

In FIG. 5, the jet 301 consists of an aft slug 350, spade jet tail 349, spade jet 342, rod/spade jet transition point 348, rod jet 343, and forward jet tip 344. Jet and slug velocities, angle of projection, thickness, spade blade width and length of both jet sections can vary depending on device 300 design. The forward longitudinal velocity of jet 301 is greatest at jet tip 344 and has a velocity gradient from the forward end jet tip 344 to the aft end spade jet tail 349. Jet 301 velocity and the velocity gradient are factors of device design, type of explosive, and the type of material used to make EW liner 305. Amongst many other design factors of device reducing the liner included angle A will increase jet velocity and the velocity gradient. The jet velocity gradient and material ductility directly affects the stretch rate of jet 301 and ultimately the length and width of both the rod jet 343 and spade jet 342 portions of jet 301, higher velocity gradients will result in a thinner and longer jet. This depiction of the jet is at a finite time after the detonation of device. The jet at an earlier time frame after detonation of HE billet 315 would be shorter in length and thicker, at a later time it would have stretched forward becoming longer and thinner because of the velocity gradient and ductile stretching of the EW liner 305 material.

The longitudinal depiction of jet 301 in FIG. 5 has the forward jet tip 344 and rod jet 343 on the right hand side of aft spade jet 342 with a middle jet transition point 348. The jet transition point 348 is where the material contributed to rod jet 343 from the collapse of the conical section B ends and the spade jet 342 material contributed by the collapse of wing section C 333 begins. The FIG. 5 jet orientation is an edge view of spade jet 342 and collapse plane 345 which is the thinnest cross-section of the spade and the result of the liner wings 325A and 325B of FIG. 3 being in the 6 and 12 o'clock positions. The spade portion of jet 301 in FIG. 5 is slightly thicker at the aft end jet tail 349 with a thinning cross-section toward the foreword end jet transition point 348 this is due to stretching from a higher velocity forward end, matching the rod jet thickness due to the longitudinal jet stretch rate.

The jet 301 is formed from the collapse of EW liner 305 caused by a detonation shock wave and converging pressure toward symmetrical axis 337 from detonating HE billet 315, that is traveling longitudinally from aft HE initiation point 307 to forward base ends 320A and 320B of device. As the detonation wave created from detonating HE billet 315 progresses from the aft end HE section A 338 forward to HE section B 339 of device it first collapses the section B of EW liner 305 starting at apex 308 and continuing forward to vertex 332A and 332B creating the rod jet 343 portion of jet 301, the collapse and jetting from section B of the liner resembles that of a typical axisymmetric conical lined shaped charge. As the detonation wave moves forward of wing vertex 332A and 332B the HE section C wing explosive 340A and 340B collapse the extended wings 325A and 325B of section C 333 starting at vertex 332A and 332B and ending at base end 320A and 320B forming the spade jet 342 portion of jet 301. Both rod and spade portions of jet 301 stretch and elongate longitudinally forward along axis 337 and spade portion 342 also widens laterally on plane 345; as time progresses after initial detonation and collapse of EW liner 305, and at some elongation length and time after collapse the higher velocity rod and spade jet will break free of the collapsed liner mass. The remaining liner mass becomes a lower velocity slug 350 represented by slug separation area 347.

FIG. 6 is a horizontal sectional view taken along line 6-6 of FIG. 3 that further illustrate the embodiment of FIG. 1 with an elevated view of collapse plane 345, the inside liner surface 317 and EW liner wing 325B. That is, the orientation of HE 315, axis 337 and horizontal plane 345 in FIG. 3B being the same as in FIG. 6; with the aft head height HE section A 338 and forward vertical line 314, full circumference conical HE section B 339 located between aft vertical line 314 and forward vertical line 313, and HE section C with wing explosive 340A and 340B forward of vertical line 313. The FIG. 6 cross-sectional cut taken along line 6-6 of FIG. 3 is coincident with vertical collapse plane 345 which intersects the axis of symmetry 337 that extends longitudinally through the middle of device 300 from the aft detonator holder 335 to the fore base end 320B of EW liner 305. FIG. 6 further clarifies how body 310, 310D and parabolic flat face 310F contain HE billet 315 and provide mounting surfaces for EW liner 305.

As shown in FIG. 6, the Axilinear shaped charge device 300 consists of a body 310, EW liner 305, high explosive (HE) billet 315, having an axisymmetric aft area with detonator 336, detonator holder 335, detonation initiation point 307, and liner apex 308, and a axisymmetric as well as planar symmetric (Axilinear) fore area that consists of liner extended wings 325A and 325B and liner base ends 320A and 325B. Initiation of the HE billet of this novel device can be achieved by any suitable readily available detonation initiation devices.

Device 300 is axisymmetric or symmetrical about a longitudinal axis 337 from the aft end near detonator 336 to the middle liner wing vertex 332A and 332B of the EW liner 305; forward of wing vertex 332A and 332B device 300 is Axilinear with two symmetrical curved extended wings 325A and 325B being axisymmetric with axis 337 and also planar symmetric about two central perpendicular reference planes, a horizontal plane in the 3 and 9 o'clock positions, and a vertical plane in the 12 and 6 o'clock positions.

Vertical line 313 of FIG. 3B share the same longitudinal position with HE 313 in FIG. 6. Vertical line 313 is longitudinally located at wing vertex of FIG. 4. The vertical 12 and 6 o'clock reference plane (FIG. 2 vertical plane 246) is coincident with axis 337 and passes through the middle of each extended wing 325A and 325B, the parabolic faces 330A and 330B are planar symmetric or mirrored about this plane. The horizontal 3 and 9 o'clock reference plane (FIG. 2 horizontal collapse plane 245) is coincident with axis 337 and passes through each wing vertex 332A and 332B, this plane is also known as the wing collapse plane and the wings 325A and 325B are planar symmetric or mirrored about this plane. The jet produced by detonating an Axilinear shaped charge device 300 is axisymmetric for the forward rod portion of the jet and planar symmetric for the aft portion, this aft spade portion of the jet being shaped somewhat like a linear shaped charge jet, thusly named Axilinear.

The Axilinear shaped charge device 300 is shown with a conical EW liner 305, other geometrical shaped (i.e. hemispherical, tulip, or trumpet) hollow cavity formed liners with extended liner wings can also be used. EW liner 305 has a full circumference axisymmetric conical profile section 322 with included angle A that is longitudinally between aft apex 308 and middle liner wing vertex 332A and 332B, and a Axilinear partial circumference wing section 333 toward the fore end with two symmetrically opposing conical fluted wing extensions 325*a* and 325B with included angle A that extend longitudinally from the middle liner wing vertex 332A and 332B to the forward liner base ends 320A and 320B.

The forward liner wing extensions 325A and 325B are symmetrical to each other and positioned one hundred and eighty degrees apart, opposing each other planar symmetrically about the horizontal plane and is axisymmetric about longitudinal axis 337 of the device. The absence of liner wall material on opposing sides of the wing section 333 at the forward base end of the liner forms two parabolic faces 330A and 330B that are parallel and symmetric with each other about longitudinal axis 337 and the vertical plane. Both liner parabolic faces 330A and 330B have a vertex at wing vertex 332A and 332B and open toward the base ends 320A and 320B with parabolic end points at the wing arc ends 321A and 321B. Forward body face 310E is located at wing vertex 332A and 332B, and fills the face hollow concavity 310F.

EW liner 305 maintains its conical profile and liner wall 309 thickness profile from aft end apex 308 of the full circumference conical section 322 to wing vertex 332 and continues with the same profile to the fore end of the extended wings 325A and 325B at the base ends 320A and 320B of the partial circumference wing section 333. Liner wall 309 transitions from a full circumference conical profile at wing vertex 332A and 332 B into 180 degree symmetrically opposing wing like or fluted extensions 325A and 325B that extend from the full circumference conical profile section 322 at wing vertex 332A and 332B to the base end 320A and 320B of the liner.

The liner wing extensions 325A and 325B shown in FIG. 6 retain the same curvature, included angle A, and wall 309 thickness profile as the full conical profile section 322 portion of the liner; but the extended wings 325A and 325B could also have a larger or smaller included angle A and wall thickness 309 than the conical section 322, as long as they maintain planar symmetry to one another. Being planar symmetric and having partial circumference conical curvature allows the wing-like extensions or flutes 325A and 325B to converge at very high pressures on the collapse plane, raising the temperature and ductility of the converging wing material to the required level for Munroe jetting.

HE billet 315 can be pressed, cast or hand packed from any commercially available high order explosive. HE billet 315 is in intimate contact with the outer liner surface 316 of EW liner 305 from the aft apex 308 to the forward wing vertex 332A and 332B of the conical profile section 322 and from the wing vertex 332A and 332B to the base ends 320A and 320B and wing arc ends 321A and 321B of the wing section 333. HE billet 315 has three distinct sections, a head height or aft HE section "A" 338 as measured longitudinally between HE initiation point 307 and liner apex 308, a mid-section or full conic HE section "B" 339 as measured longitudinally from apex 308 to wing vertex 332A and 332B, that fully encompasses the liner conical section 322, and forward HE section "C" that contains two partial circumference wing HE sections 340A and 340B as measured longitudinally from wing vertex 332A and 332B to base ends 320A and 320B that conform to the shape of the liner wing extensions 325A and 325B.

HE section A 338 can be lengthened or shortened longitudinally by increasing or decreasing the length of body 310, greater head height gives a flatter detonation wave before it comes in contact with the liner. Flatter detonation waves at time of liner impact typically increase jet tip velocity and target penetration, head height optimization is a balance between jet performance and minimizing the explosive charge. The optimum head height can be determined by computer code and live testing to obtain the least amount HE volume needed to efficiently obtain maximum jet mass, velocity and target penetration. A typical head height for a conical lined shaped charge would be ½ inch space permitting.

The shape and volume of HE section B 139 is defined by the area between the inside surface 312 of body 310 and outside surface 316 of EW liner 305 from aft apex 308 to forward body face 310E located at wing vertex 332A and 332B, and makes a full circumference or revolution around liner section 322. The shape and volume of the two symmetrical wing HE sections 340A and 340B of HE section C 340 are defined by the area between the inside surface 312 of body 310 and outside surface 316 of EW liner 305 from aft wing vertex 332A and 332B to forward base ends 320A and 320B, and are partial circumference volumes about each wing between the wing arc end points 321A and 321B. HE billet 315 can have a super-caliber diameter (i.e. larger than the liner base diameter) necessary for full convergence of the base end of the liner wing extensions 325A and 325B to obtain maximum velocity and mass of the spade jet.

The forward section C 333 consists of two less than full circumference liner walls 309 extending beyond the end of section B 322, creating partial conical or curved wing extensions 325A and 325B, wing vertices 332A and 332B and parabolic faces 330A and 330B that are symmetrically one hundred and eighty degrees apart. The wing vertex 332A and 332B and flat parabolic faces 330A and 330B are formed from the absence of material on two symmetrically opposing sides of the base end of the conical profile. The wing extensions 325A and 325B create an axisymmetric and planar symmetric opposing partial radial hollow concavities on the inside liner wall surface 317; HE detonation pressures on these concavities provides a partial radial convergence and work into the liner material to cause it to rise in temperature and ductility causing plastic flow and hydrodynamic jetting.

The collapse of the wing extensions 325A and 325B of section C 333 produces a wide planar symmetric stretching non round spade shaped jet which cuts a deep slot rather than a round hole; the mass, width, length, stretch rate, velocity, and time of flight of the spade jet is directly proportional to the liner wall length of section C 333, included angle A, and liner wall 309 thickness of section C 333. If section C 333 is shortened and the overall length "L" is unchanged section B 322 will become longer. Increasing the length of section B 322 will increase the rod jet length, mass and penetration depth, and will decrease the length, width, mass and penetration depth of the spade jet; length adjustments to sections B and C work in concert, when the rod jet is lengthened the spade jet will be shortened and vice versa shortening the rod jet will lengthen the spade jet.

During collapse of the liner full conical section 322, liner material radially converges along the longitudinal axis 337 into a rod jet from the detonation of HE section A 338 and HE section B 339; the collapse of full conical section 322 is followed by the collapse of the extended liner wings 325A and 325B of the partial circumference section 333 into a spade jet from the detonation of wing HE sections 340A and 340B of HE section C. Wing HE sections 340A and 340B are coupled to the outer liner surface 316 of each wing from the aft wing vertex 332A and 332B to the forward wing base ends 320A and 320B and the wing arc ends 321A to 321B.

The radial curvature of the opposing liner wing extensions 325A and 325B provides the radial material convergence during collapse needed to raise the temperature and pressure of the collapsed liner material, to the required level for plastic flow and Monroe jetting to occur, this increases the ductility allowing for longer jet breakup length. During collapse the full conical section 322 of the liner will form an axisymmetric rod jet along the longitudinal axis 337 followed by the concave liner wing extensions 325A and 325B being driven to a common collapse plane by HE 340A and 340B, the colliding wing extensions material will form into a high velocity flat planar symmetric spade shape jet.

As the collapsed wing extensions material moves forward along longitudinal axis 337 it also spreads laterally outward forming the spade shaped jet along the horizontal collapse plane. The formation of the spade jet is due to the absence of liner material, explosive and confinement on the liner sides with the two flat parabolic faces 330A and 330B that are adjacent to and ninety degrees out of phase from the flutes or wing extensions 325A and 325B. The orientation of device 300 can be rotated about axis 337 and the spade jet orientation will rotate equally in the same direction, if device 300 is rotated 45 degrees clockwise about axis 337 the collapse plane will also rotate 45 degrees clockwise and the spade jet will stretch longitudinally forward on axis 337 and laterally along the rotated collapse plane.

The EW liner 305 is the working material of the shaped charge and is mounted to body 310 at the forward end of device 300, at the base ends 320A and 320B of the liner wing extensions 325A and 325B; and adjacent to the wings the liner parabolic faces 330A and 330B are mounted to the body 310 parabolic faces 310F. Body 310 consist of four distinct areas, a aft cylindrical area 310C that provides mounting for an initiation device that is coupled to the aft end of HE 315, followed by a boat tailed area 310B that contains the HE section A 338, followed by cylindrical area 310A that contains HE section B 339 that is coupled to the full conical liner section 322; and HE section C containing wing sections 340A and 304B that are coupled to the extended wings of liner section 333, and body area 310D at the forward end of cylindrical section 310A that transitions from a cylindrical shape into two parallel flat parabolic faces 310F that are planar symmetric to each other and are coupled to the parabolic liner faces 330A and 330B.

Body area 310D has two functions, it provides two opposing side mounting faces 310F for the liner extended wings and also has flat faces 310E that is the forward containment boundary of HE section 339; this boundary is located at wing vertex 332A and 332B, and is also the liner wing transition point from the full circumference conical section 322 to the extended wing section 333. The containment of HE pressures during the detonation time period by body area 310D is important for proper collapse of the wings and spade jet formation. Shape charge liners for the most part are made from copper but liners may be made from most any metal, ceramic, powdered metals, tungsten, silver, copper, glass or combination of many materials. Body 310 would typically be made from aluminum or steel but could be made of almost any metal or plastic as long as it provides the correct amount of tamping for proper jet formation and desired jet velocity during the detonation of HE billet 315.

The EW liner 305 is a modified cone or other shape with two distinct geometrical sections, the aft end of the liner is a full conical profile section 322 with an apex 308, followed by the forward end wing section 333 with two liner wing extensions 325A and 325B that extend forward from the full conical or other shape profile section 322 at wing vertex 332A and 332B to the wing base ends 320A and 320B at the fore end of EW liner 305. The liner wing extensions 325A and 325B maintain the same included angle A liner wall 309 thickness profile and curvature of the full conical profile section 322.

The included angle A of EW liner 305 needed to obtain Munroe effect jetting should be from 36 to 120 degrees. The jet velocity achieved from a shaped charge is dependent on the liner wall 309 thickness and included angle A of the liner; a narrower included angle results in a faster less massive jet, and a wider included angle results in a slower more massive jet. Jet velocities can vary from 4 to 10 km/s depending on the type and quality of liner material, included angle A of the liner, liner wall 309 thickness, the charge to mass ratio of HE to liner, bulk density of the liner, surface finish of the liner wall, and body geometries; very small changes of any of these variables can make large differences in jet velocity and trajectory.

The HE billet 315 is contained between the inner surface 312 of body 310 and the outer surface 316 of the EW liner 305. HE billet 315 provides the energy to collapse the EW liner 305, increasing the ductility of the EW liner 305 material, causing it to form a compound jet in the shape of a very high speed rod jet from the full conical section 322 material followed by a flattened spade shaped jet from the liner wing section 333 material; the spade jet is slower than the rod jet from conical section 322 but much faster than a typical "V" shaped liner found in common linear shaped charge because of the cavity of the wing section 333.

Body 310 provides a mounting surface for EW liner 305 which is held to body 310 at the liner base ends 320A and 320B and at the parabolic faces 330A and 330B. The base end of EW liner 305 does not form a full circumference; it consists of two opposing concave surfaces or wing extensions 325A and 325B and the corresponding wing base ends 320A and 320B at the forward end of the liner. Body 310 also serves as a containment vessel for the delicate HE billet 315 and protects it from damage or impact by supporting the outer diameter of HE billet 315. Body 310 also provides tamping for the HE billet 315 depending on body wall 306 thickness and material density, HE tamping can be increased or decreased if needed to improve jet performance or reduce total HE mass.

The purpose of removing the base end material on symmetrically opposing sides of EW liner 305 and creating the wing-like extensions 325A and 325B is twofold. The first purpose is to form the partial circumference conical wing-like extensions or flutes 325A and 325B and when collapsed converge to form the flat aft spade shaped portion of the jet; the flattened spade jet spreads laterally and erodes an elongated slot in target material. The second purpose being to allow for close lateral proximity of multiple adjacent devices resulting in multiple tightly spaced rod and intersecting spade jet perforations, creating a large coupled slotted target perforation.

Since the EW liner 305 material is not being confined along the two removed portions of the liner at parabolic faces 330A and 330B, the collapse of the wing-like extensions or flutes 325A and 325B will produce a flat jet, much like a linear shaped charge, but at a much higher velocity, stretching laterally and longitudinally. The transition from the conical profile section 322 to the remaining wing-like extensions or flutes 325A and 325B of EW liner 305 is very gradual so as to maintain continuity between the rod and spade portions of the jet.

The shaped charge body 310 has a frustoconical or boat tailed portion 310B near the aft end of the shaped charge device 300 that begins at detonator holder 335 and increases in diameter longitudinally to about the apex 308 of EW liner 305. The cylindrical portion 310A of the body 310 begins at about the apex 308 of the EW liner 305 and extends longitudinally to the forward end of device 300. The forward end of cylindrical portion 310A has two planar symmetrical 310D portions, each with a cylindrical outer face 310G, an inner parabolic flat face 310F and internal flat face 310E. The two internal parabolic flat faces 310F of the body begin at the liner wing vertex 332A and 332B and end at wing arc ends 321A and 321B; faces 310F are symmetrical and parallel to each other, and perpendicular with the wing collapse plane that is centrally located and collinear with longitudinal axis 337 between the two flat faces 310F.

Flat faces 310F and faces 310E of the shaped charge body 310D help confine the wing HE 340A and 340B portion of HE billet 315 by providing cavity closure between the flat faces 310F and the liner parabolic faces 330A and 330B on each side of the wing-like extensions or flutes 325A and 325B of the EW liner 305. The body 310 preferably tapers or boat tails smaller in some manner toward the rearward end 310B from aft of the liner apex 308 toward the detonator holder 335 minimizing the overall mass of HE billet 315, reducing the amount of explosive by boat tailing body 310 increases the charge efficiency without affecting the liner collapse performance, and reduces unwanted collateral target damage from excessive explosive mass.

The invention described and depicted herein produces a two part stretching jet, the forward portion is a rod like asymmetric jet and the aft portion is spread into a sheet like planar symmetric shape reminiscent of the jetting of a linear shaped charge. In order to achieve the greatest jet length and penetration depth the jetting process of a shaped charge requires the liner material to reach a high temperature during collapse, which allows plastic flow of the collapsed liner material and produces a long stretching jet. Since jet length and penetration are directly proportional it is reasonable to make the greatest effort to provide the longest and most robust jet possible.

The above description of the directions of the shaped charge body and liner can be reversed whereby the axisymmetric jet is aft of the spade jet, there can be multiple sections alternating from axisymmetric and planar symmetric sections that produce alternating spade rod spade rod jet. The sections making up a liner do not have to have the same internal angle, thickness profile or material. The internal angles of these sections can vary from 36 degrees to 120 degrees and still produce Munroe jetting, that is to say a ductile jet having a velocity gradient from tip to tail. The arc length of each wing as encompassed by radial lines radiating from the central axis and intersecting each cord end of the arc of the wing can vary from 90 to 140 degrees.

An apex 308 toward the aft end of the full circumference conical section "B" 322, and a partial circumference wing section "C" 333 with base ends 320A and 320B, liner wing extensions 325A and 325B, and wing base arc ends 321A and 321B toward the forward end of EW liner 300. The liner wing extensions 325A and 325B extend or protrude in a forward direction from section A 322 beginning at wing vertex 332A and 332B and ending at the base ends 320A and 320B. Wing vertex 332A and 332B are positioned longitudinally at vertical line 313 where the liner transitions from the full circumference conical section B 322 into a partial circumference conical or other shape wing section C 333. Liner wall 309 of section B 322 and section C 333 can vary in thickness, curvature, and included angle A can be increased or decreased to achieve desired rod and spade jet velocities and mass.

The conical section B 322 and wing section C 333 share a common longitudinal symmetrical axis 337, section C 333 also has a horizontal collapse plane 345 in the 3 to 9 o'clock position and vertical plane 346 in the 12 to 6 o'clock position they are perpendicular to each other and intersect each other at symmetrical axis 337. Section B 322 is axisymmetric or symmetrical about axis 337 in all radial planes for 360 degrees, whereas section C 333 has two parabolic faces 330A and 330B that are planar symmetric about vertical plane 346; and two extended wings 325A and 325B that are planar symmetric about horizontal plane 345 and also axisymmetric between the wing arc ends 321A and 321B about axis 337. The EW liner 300 is a modified hollow cone, but could also be other relative hollow shapes (i.e. hemisphere, trumpet, tulip), having two opposing equal sections removed at the base end of the liner, creating two extended wings like 325A and 325B and two parabolic faces like 330A and 330B.

The absence of the two opposing equal liner wall sections at the liner base end creates two equal 180 degree opposed liner wing extensions 325A and 325B or flutes. The included angle A of the hollow conical liner and the longitudinal length of the full section B 322 portion of the liner determines the longitudinal wing length from wing vertex 332A and 332B to the base end 320A and 320B of the extended wings 325A and 325B or fluted portions of the liner and thusly the amount of the liner wall 309 material that is dedicated to producing the spade or flattened portion of the jet. The longitudinal length of section B 322 and the extended wings 325A and 325B or flutes can be increased or decreased to achieve the desired ratio of rod to spade length of the jet created from EW liner 300. The thickness of the liner wall 309 can gradually increase or decrease from the apex 308 to the base end 320A and 320B or anywhere along the wall length; a tapering liner wall 309 thickness will help balance the liner to HE mass ratio as the liner cone diameter increases toward the base end 320A and 320B.

After the collapse of full conical section B 322 by HE section B into a rod jet the curved wing-like extensions or flutes 325A and 325B of wing section C 333 are driven to horizontal plane 345 and symmetrical axis 337 of the EW liner 305 by the HE section C with wing explosive 340A and 340B, the colliding material forms a flat blade shape jet instead of a round jet because of the lack of liner material and HE confinement on the flat faced sides 310F that are ninety degrees out of phase from the wing-like extensions or flutes 325A and 325B. The transition from conical section B 322 to wing section C 333 is gradual which allows the spade jet to stay connected to the forward rod jet as both portions of the jet stretch longitudinally forward along axis 337; and because of the lack of liner confinement on the two opposing parabolic faces 310F the spade jet will widen laterally on horizontal plane 345 as it stretches longitudinally forward with the forward rod jet.

Figure 7:
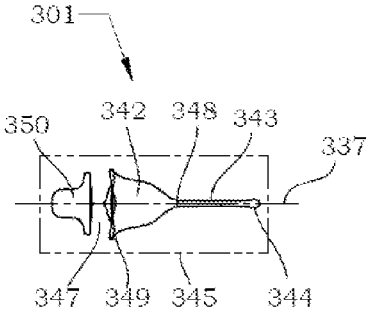
FIG. 7 is a view of the jet formed by the device embodiment of FIG. 1 that illustrates the orientation of the spade jet with respect to the liner wings in FIG. 6.

Vertical plane 345 is the convergence plane where the explosively driven liner material of the 180 degree opposing concave liner wing extensions 325A and 325B (only one wing 325B can be viewed from the FIG. 6 cross sectional elevated view) of EW liner 305 will converge and form spade jet 342 of FIG. 7. The liner wing extensions 325A and 325B are planar symmetric to each other about vertical plane 345, and the orientation of the resultant spade jet 342 of FIG. 7, at a given time post detonation, is correctly oriented to represent the collapse of the EW liner 305 from the view point of FIG. 6. The jet consists of a slug 350, slug separation area 347, spade jet tail 349, spade jet 342, spade/rod jet transition point 348, rod jet 343, and jet tip 344. This depiction of the jet is at a finite time after the detonation of the device, since the jet has a velocity gradient from tip to tail the longer the time of flight after detonation the longer will be the resulting jet.

In the singular use of the Axilinear device 300, HE billet 315 detonation is initiated at initiation point 307, the HE billet 315 detonation wave advances from HE section A 338 forward to HE section B 339 toward the front of the device collapsing the EW liner 305 full conical section B 322 forming rod jet 343 followed by the collapse of extended wings 325A and 325B of section C 333 by the detonation of HE section C wing explosive 340A and 340B forming the wide flattened spade jet 342.

After the collapse of full conical section B 322 by HE section B into a rod jet the curved wing-like extensions or flutes 325A and 325B of wing section C 333 are driven to horizontal plane 345 and symmetrical axis 337 of the EW liner 305 by the HE section C with wing explosive 340A and 340B, the colliding material forms a flat blade shape jet instead of a round jet because of the lack of liner material and HE confinement on the flat faced sides 310F that are ninety degrees out of phase from the wing-like extensions or flutes 325A and 325B. The transition from conical section B 322 to wing section C 333 is gradual which allows the spade jet to stay connected to the forward rod jet as both portions of the jet stretch longitudinally forward along axis 337; and because of the lack of liner confinement on the two opposing parabolic faces 310F the spade jet will widen laterally on horizontal plane 345 as it stretches longitudinally forward with the forward rod jet.

The horizontal plane 345 of the wing section C 333 is seen as a horizontal longitudinal line that is coincident with symmetrical axis 337 in FIG. 4. Horizontal plane 345 is where the liner material of the two 180 degree opposing extended axisymmetric and planar symmetric wing extensions 325A and 325B of EW liner 305 will converge from the detonation pressures of HE section C with wing explosive 340A and 340B forming the spade jet 342 shown in FIG. 5. Horizontal plane 345 also represents the orientation and direction of the wide lateral cross-section of spade jet 342, which are coplanar and coincident to each other. The liner wing extensions 325 of FIG. 4 and the view of jet 301 of FIG. 5 are correctly oriented to each other to represent the collapse of the EW liner 305 from this viewpoint, the spade jet 342 is seen as a thin section along symmetrical axis 337 and horizontal plane 345 that decreases in thickness from the aft end spade jet tail 349 to the forward end rod/spade transition point 348 where it is connected to the aft end of rod jet 343. Jet 301 would form within the hollow cavity of EW liner 305 of device 300 and at some time after liner collapse would eventually stretch past the base end 325A and 325B, it is shown in FIG. 5 fully outside of and to the right of the device for easier viewing.

Body 310 contains and protects HE billet 315 and provides a mounting surface for EW liner 305 at its base ends 320A and 320B. The HE billet 315 detonation is initiated by any suitable commercially available detonator 336 on the device symmetrical axis 337 at initiation point 307. With respect to the longitudinal symmetrical axis 337 of device 300, the liner full circumference conical section B 322 is aft of wing vertex 332A and the liner wing section C 333 is forward of the wing vertex 332A. The jet 301 produced by device 300 has three distinct regions and shapes; a high velocity 7-9 km/s round axisymmetric rod jet 343 with forward jet tip 344 and aft rod/spade jet transition point 348, followed by a lower velocity 4-7 km/s planar symmetric flattened spade jet 342 mid-section and jet tail 349, followed by the slug separation area 347 and a low velocity ½ km/s slug 350.

The forward axisymmetric rod jet 343 in FIG. 5 is formed from the conical section B 322 of EW liner 305 that starts at apex 308 and ends at the wing vertex 332A of the parabolic flat face 330A. At wing vertex 332A the conical section B 322 of the liner transitions into the wing section C 333 with two opposing concave liner wing extensions 325A and 325B or flutes, formed due to the liner side truncation. The aft spade jet 342 is formed from the collapse of the liner wing section C 333 opposing liner wing extensions 325A and 325B portions of EW liner 305. The aft spade jet 342 being flat and wide, similar to a conventional linear shaped charge jet but more massive, directionally controllable and at a much higher velocity, thus the Axilinear name. The amount of liner material designated to the aft and forward portions of the combination spade and rod jet can be adjusted by shortening or lengthening conical section B 322 and wing section C 333 of EW liner 305 to give differing lengths and widths of rod and spade shaped jet sections.

In FIG. 7, the jet 301 consists of an aft slug 350, spade jet tail 349, spade jet 342, rod/spade jet transition point 348, rod jet 343, and forward jet tip 344. Jet and slug velocities, angle of projection, thickness, spade blade width and length of both jet sections can vary depending on device design. The forward longitudinal velocity of jet 301 is greatest at jet tip 344 and has a velocity gradient from the forward end jet tip 344 to the aft end spade jet tail 349. Jet 301 velocity and the velocity gradient are factors of device design, type of explosive, and the type of material used to make EW liner. Amongst many other design factors of device reducing the liner included angle A will increase jet velocity and the velocity gradient. The jet velocity gradient and material ductility directly affects the stretch rate of jet 301 and ultimately the length and width of both the rod jet 343 and spade jet 342 portions of jet 301, higher velocity gradients will result in a thinner and longer jet. This depiction of the jet is at a finite time after the detonation of device. The jet at an earlier time frame after detonation of HE billet would be shorter in length and thicker, at a later time it would have stretched forward becoming longer and thinner because of the velocity gradient and ductile stretching of the EW liner material.

The longitudinal depiction of jet 301 in FIG. 5 has the forward jet tip 344 and rod jet 343 on the right hand side of aft spade jet 342 with a middle jet transition point 348. The jet transition point 348 is where the material contributed to rod jet 343 from the collapse of the conical section B ends and the spade jet 342 material contributed by the collapse of wing section C 333 begins. The FIG. 5 jet orientation is an edge view of spade jet 342 and collapse plane 345 which is the thinnest cross-section of the spade and the result of the liner wings of FIG. 3 being in the 6 and 12 o'clock positions. The spade portion of jet 301 in FIG. 5 is slightly thicker at the aft end jet tail 349 with a thinning cross-section toward the foreword end jet transition point 348 this is due to stretching from a higher velocity forward end, matching the rod jet thickness due to the longitudinal jet stretch rate.

The jet 301 is formed from the collapse of EW liner caused by a detonation shock wave and converging pressure toward symmetrical axis from detonating HE billet, which travels longitudinally from aft HE initiation point to forward base ends of device. As the detonation wave created from detonating HE billet progresses from the aft end HE section A forward to HE section B of device it first collapses the section B of EW liner starting at apex and continuing forward to vertex creating the rod jet 343 portion of jet 301, the collapse and jetting from section B of the liner resembles that of a typical axisymmetric conical lined shaped charge. As the detonation wave moves forward of wing vertex the HE section C wing explosive 340A and 340B collapse the extended wings of section C starting at vertex and ending at base end forming the spade jet 342 portion of jet 301. Both rod and spade portions of jet 301 stretch and elongate longitudinally forward along axis and spade portion 342 also widens laterally on plane 345; as time progresses after initial detonation and collapse of EW line, and at some elongation length and time after collapse the higher velocity rod and spade jet will break free of the collapsed liner mass. The remaining liner mass becomes a lower velocity slug 350 represented by slug separation area 347.

Figure 8:
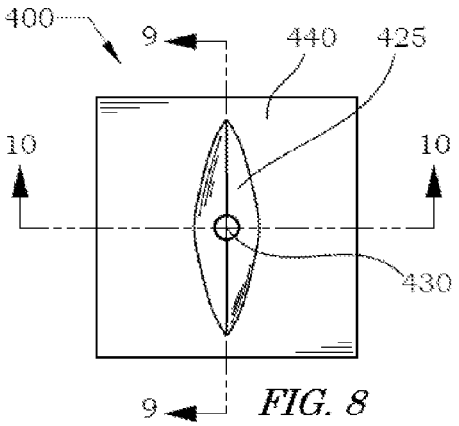
FIG. 8 is an end view of a target surface with a cavity created by a single Axilinear shaped charge jet from the embodiment shown in FIG. 1.
Figure 9:
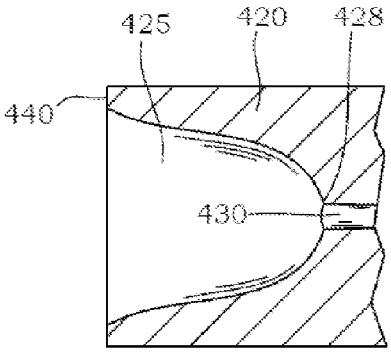
FIG. 9 is a vertical sectional view along line 9-9 in FIG. 8 that is coplanar with the collapse plane of the liner wings of the embodiment of FIG. 1 and further clarifies the wide direction of the cavity created by the spade jet.
Figure 10:
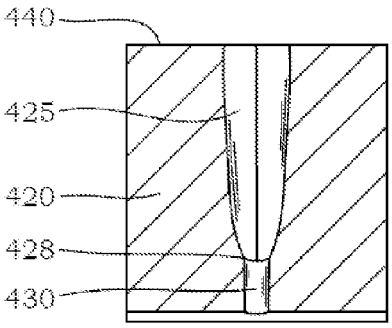
FIG. 10 is a horizontal sectional view along line 10-10 in FIG. 8 that is perpendicular with the collapse plane of the liner wings of the embodiment of FIG. 1 and further clarifies the narrow direction of the cavity created by the spade jet.

FIGS. 8, 9 and 10 illustrate a target 400 with a hole profile made by the combination rod/spade jet from the detonation of Axilinear device of FIG. 6. The vertical elongated hole 425 shown in FIG. 8 on target surface 440 is made by the spade portion of the jet and the circular deep perforation 430 is made by the rod portion of the jet following detonation of an Axilinear device of FIG. 6. Elongated hole 425 will be wider by a factor of two or greater, than the charge diameter CD of the FIG. 1 embodiment when detonated at a given optimal 2-3 CD standoff from target surface 440. The bottom face 428 of elongated slot 425 is where the spade jet hydrodynamic penetration stops and the circular deep perforation 430 is centered on the bottom face 428. Multiple Axilinear devices can also be combined into a circular, polygonal, linear, splined or other patterned array to produce very large connected target penetrations.

FIG. 9 is a vertical sectional view taken along line 9-9 of FIG. 8 that further illustrates the wide elongated hole 425 in target material 420 made by the spade jet that is proceeded by a large deep circular hole 430 at its center made by the rod jet. Vertical line 9-9 is coplanar with the collapse plane of the extended wing portion of the FIG. 6 embodiment. FIG. 10 is a horizontal sectional view taken along line 10-10 of FIG. 8 that further illustrates the cavities made by the jet of the embodied FIG. 1 device in target 400, in this section view we see the narrow view of the slot made by the spade jet followed by the deep hole 430 made by the rod jet. Line 10-10 is perpendicular to the collapse plane of the spade jet. Longer or shorter standoffs of the FIG. 1 embodied device with the target surface 440 will lengthen or shorten the slot 425 width and depth. The cavity in target 400 is what would be expected if the target material 420 was a metal or other material with properties similar to metal, much larger cavities with many surrounding fractures would be expected in a masonry or rock like material.

FIGS. 12, 13, 14, 15, 16, and 17 show some possible variations of the FIG. 2 Axilinear liner embodiment that can be implemented in the FIG. 1 embodied device 100 to modify the spade jet width, length, velocity and mass.

Figure 13:
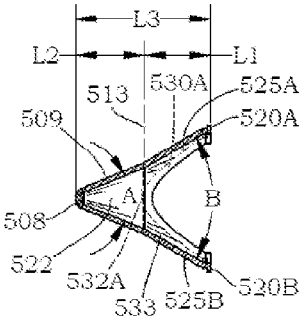
FIG. 12-14 is a diverging wing variation of the liner embodiment shown in FIG. 2.
Figure 12:
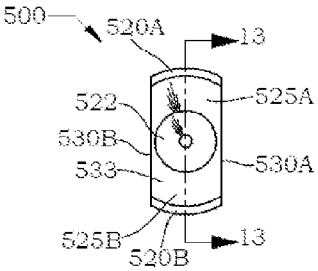
Figure 14:
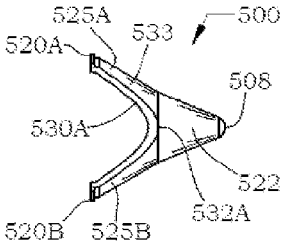

FIG. 12 is a base end view of EW liner 500 a diverging variation with diverging extended wings. FIG. 13 is a vertical sectional view taken along line 13-13 of FIG. 12 illustrating the diverging extended wings 525A and 525B with an included angle B of the partial circumference wing section 533 being greater than included angle A of the full circumference conical section 522. FIG. 14 further clarifies the construction of the diverging EW liner 500. EW Linear 500 has all the main features and characteristics of the FIG. 2 embodiment with the addition of a diverging wing section 533 that has a included angle B wider than the conical section 522 included angle EW Linear 500 has a full conical section 522 with an aft apex 508, included angle A, conical length L2 and forward wing apex 532A at vertical line 513. Namely, EW Liner 501 has a full conical section 522 with an aft apex 508, included angle A, conical length L2 and forward wing apex 532A at vertical line 513. Wing section 533 begins at vertical line 513 with two extended wings 525A and 525B protruding forward, flat parabolic faces 530A and 530B, wing length L1, and forward base ends 520A and 520B. The liner wall 509 transition at radial line 513 from the aft axisymmetric conical section 522 portion of the EW liner 500 to the remaining forward axisymmetric and planar symmetric wing section 533 is a gradual transition of the two sections at radial line 513 so as to maintain jet continuity between the rod and spade jets. The purpose of diverging wings is to decrease the velocity of the spade portion of the jet and increase its mass. EW liner 500 wings included angle B can be between 30 and 120 degrees and still produce viable spade jetting.

Figure 16:
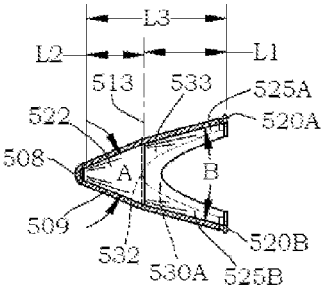
FIG. 15-17 is a converging wing variation of the liner embodiment shown in FIG. 2.
Figure 15:
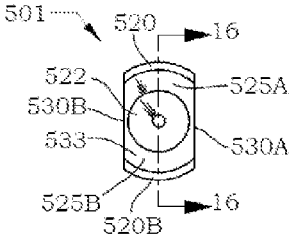
Figure 17:
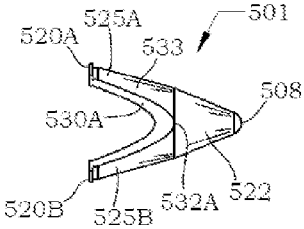
Figure 18:
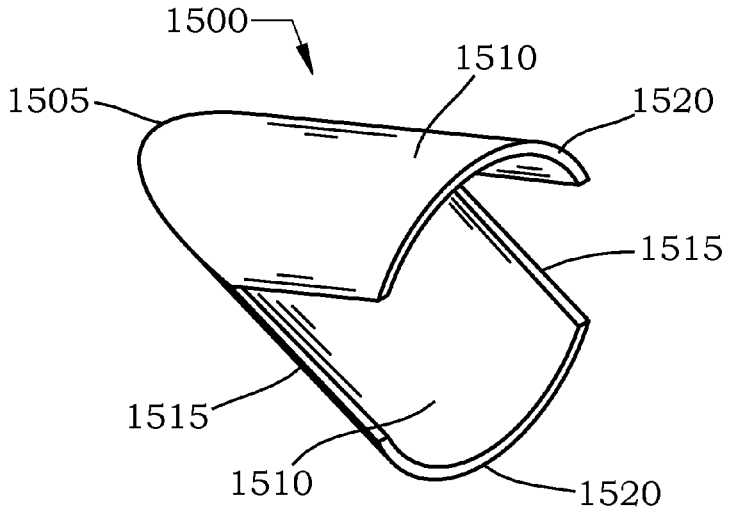
FIG. 18 is a perspective view of an alternative embodiment of a shaped charge liner with a parabolic pole or apex and extended wings.
Figure 19:
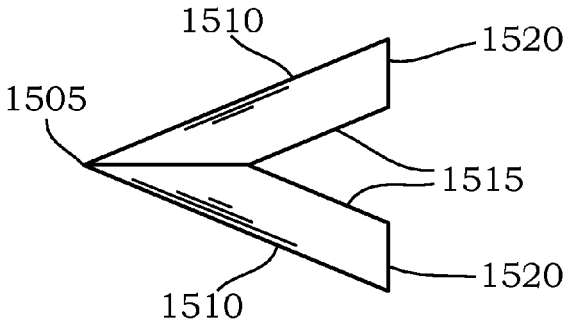
FIG. 19 is a side view of the FIG. 18 embodiment of a shaped charge liner with a parabolic pole or apex and extended wings.
Figure 20:
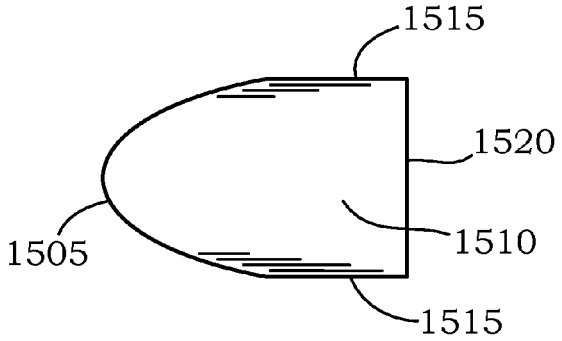
FIG. 20 is a top view of the FIG. 18 embodiment of a shaped charge liner with a parabolic pole or apex and extended wings.
Figure 21:
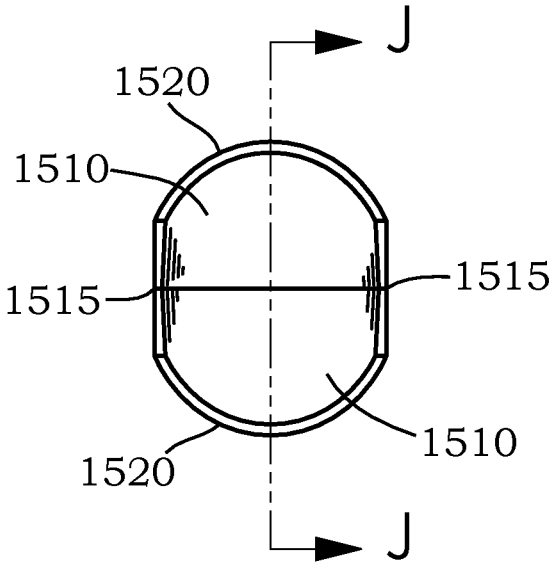
FIG. 21 is a front end view of the FIG. 18 embodiment of a shaped charge liner with a parabolic pole or apex and extended wings.
Figure 22:
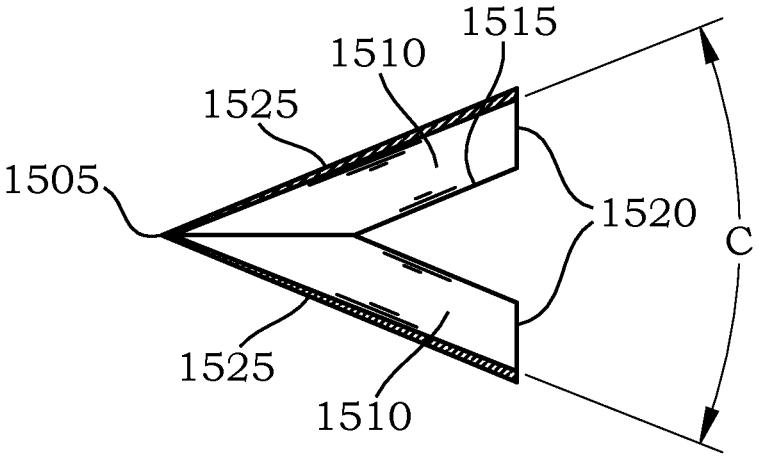
FIG. 22 is a longitudinal section view along line J-J in FIG. 21 embodiment of a shaped charge liner with a parabolic pole or apex and extended wings.

FIGS. 15, 16, and 17 illustrate a EW liner 501 variation with converging extended wings 525A and 525B with an section 533 with an included angle B less than included angle A of conical section 522. FIG. 15 is a base end view of the EW liner 501 converging variation with converging extended wings 525A and 525B. FIG. 16 is a vertical sectional view taken along line 16-16 of FIG. 15 illustrating the converging extended wings 525A and 525B with an included angle B of the partial circumference wing section 533 being less than included angle A of the full circumference conical section 522. FIG. 17 further clarifies the construction of the converging EW liner 501.

EW Liner 501 has all the main features and characteristics of the FIG. 2 embodiment except having a narrower included angle B of a converging wing section 533 than the conical section 522 included angle A. Namely, EW Liner 501 has a full conical section 522 with an aft apex 508, included angle A, conical length L2 and forward wing apex 532A at vertical line 513. Wing section 533 begins at vertical line 513 with two extended wings 525A and 525B protruding forward, flat parabolic faces 530A and 530B, wing length L1, and forward base ends 520A and 520B. The liner wall 509 transition at vertical line 513 from the aft axisymmetric conical section 522 portion of the EW liner 501 to the remaining forward axisymmetric and planar symmetric wing section 533 is a gradual transition of the two sections at radial line 513 so as to maintain jet continuity between the rod and spade jets. The purpose of diverging wings is to increase the velocity of the spade portion of the jet and decrease its mass. EW liner 501 wings included angle B can be between 30 and 120 degrees and still produce viable spade jetting.

FIG. 18-21 illustrate an alternative embodiment of a liner variation liner 1500 that is placed into a shaped charge device housing, body, explosive billet, and detonator as described and shown above with respect to FIGS. 1, 3A-B, 4, 6 (and related figures), including all components, configurations, and possible modifications and variations thereof. Namely, each shaped charge device is configured in a manner where each shaped charge "a shaped charge" is an explosive device, having a shaped liner, driven by a similarly shaped mating explosive billet, having an initiation device, the necessary containment, confinement and retention of the liner to the explosive billet.

The result of detonation of this device is a high speed stream of material produced from the convergence of the liner driven by the explosive. This is commonly known as the Munroe Effect. The shape and size of this stream of material commonly called a jet, is dependent on the starting shape and size of the liner and explosive billet.

Half pipe liner 1500 has a parabolic apex or pole 1505 toward the aft end, a notch 1515 on each side of the concave wings 1510 toward the fore end, and liner base end 1520 on each wing. Liner 1500 resembles two angled half sections of thin walled pipe butted together at the apex or pole 1505 and when properly driven by a high explosive will produce a spade shaped stretching Munroe jet that erodes a deep elongated hole in a target.

Liner 1500 has two planer symmetric opposing equal wing 1510 sections of material at the aft base end of the liner, and two 180 degree opposed "V" shaped notches 1515. The absence of the material in the V notches 1515 at the liner base end creates two equal 180 degree opposed liner concave extended wings 1510. Liner wall thickness of shaped charges are scaled to the overall diameter of the device, the liner wall 1525 should increase in thickness as the device diameter increases and decrease in thickness as the device diameter decreases.

Shaped charges have varying wall thicknesses and profiles depending on the desired effect on a target. The liner wall 1525 can vary or taper in thickness from the aft apex 1505 to the forward base end 1520 and can be thicker near the base end but can also be thinner at the base end 1520 than apex 1505 if needed, wall thickness and taper is application dependent. Liner 1500 could be made from many profiles including cones, tulips, trumpets, hemispherical, or other shapes to accomplish desired effects on targets.

The half pipe line 1500 produces a purely planar symmetric jet by convergence of symmetric opposing equal wing 1510 section and the opposed "V" shaped notches 1515 on the sides of the liner 1500, which produces a planar symmetric stretching wide and round jet which cuts a slot rather than a round hole as produced by the rod portion of the jet.

More particularly, the half pipe liner 1500 can be implemented with the non-liner components of the shape charge unit shown and described in FIGS. 1, 3A-B, 4, 6 (and related figures), where the shaped charge device 100 consist of a body 110, EW liner 105, high explosive (HE) billet 115, having an axisymmetric aft area with detonator 136, detonator holder 135, detonation initiation point 107. Initiation of the HE billet of this novel device can be achieved by any suitable readily available detonation initiation devices.

The half pipe liner 1500 can be implemented with the non-liner components of the shape charge unit shown and described in FIGS. 1, 3A-B, 4, 6 (and related figures), where HE billet 115 can be pressed, cast or hand packed from any commercially available high order explosive. HE billet 115 is in intimate contact with the outer liner surface 116 of liner 1500. HE billet 115 has three distinct sections, a head height or aft HE section "A" 138 as measured longitudinally between HE initiation point 107 and liner apex 1505, a mid-section or parabolic HE section "B" 139 as measured longitudinally from apex 1505 to wing vertex 1515 that fully encompasses the liner parabolic section, and forward HE section "V" that contains two partial circumference wing HE sections 1510 as measured longitudinally from wing vertex 1515 to forward base ends 1520 the liner wing extensions.

HE section A 138 can be lengthened or shortened longitudinally by increasing or decreasing the length of body 110, greater head height gives a flatter detonation wave before it comes in contact with the liner. Flatter detonation waves at time of liner impact typically increase jet tip velocity and target penetration, head height optimization is a balance between jet performance and minimizing the explosive charge. The optimum head height can be determined by computer code and live testing to obtain the least amount HE volume needed to efficiently obtain maximum jet mass, velocity and target penetration. A typical head height for a conical lined shaped charge would be ½ inch space permitting.

The half pipe liner 1500 can be implemented with the non-liner components of the shape charge unit shown and described in FIGS. 1, 3A-B, 4, 6 (and related figures), where the shape and volume of HE section B 139 is defined by the area between the inside surface 112 of body 110 and outside surface 116 of EW liner 105 from aft apex 108 to forward body face 110E located at wing vertex 1515 (second winged section), and makes a full circumference or revolution around a first parabolic liner section. The shape and volume of the two symmetrical wing HE sections 1510 of HE section C is defined by the area between the inside surface of body 110 and outside surface 116 of liner 1500. HE billet 115 can have a super-caliber diameter (i.e. larger than the liner base diameter) necessary for full convergence of the base end of the liner wing extensions to obtain maximum velocity and mass of the spade jet.

The wing extensions 1510 create a planar symmetric opposing partial radial hollow concavities on the inside liner wall surface; and as the HE billet detonates, the pressures on these concavities provides a partial radial convergence and work into the liner material to cause it to rise in temperature and ductility causing plastic flow and hydrodynamic jetting. The collapse of the wing extensions 1510 produces a wide planar symmetric spade shaped jet which cuts a deep slot rather than a round hole; the mass, width, length, stretch rate, velocity, and time of flight of the spade jet is directly proportional to the liner wall length included angle C, and liner wall thickness. If section C is shortened and the overall length "L" is unchanged section B will become longer. Increasing the length of section B will increase the rod jet length, mass and penetration depth, and will decrease the length, width, mass and penetration depth of the spade jet; length adjustments to sections B and C work in concert, when the rod jet is lengthened the spade jet will be shortened and vice versa shortening the rod jet will lengthen the spade jet.

As the collapsed wing extensions material moves forward along longitudinal axis it also spreads laterally outward forming the spade shaped jet along the horizontal collapse plane. The formation of the spade jet is due to the absence of liner material, explosive and confinement on the liner sides with the two flat parabolic faces that are adjacent to and ninety degrees out of phase from the flutes or wing extensions 1510. The orientation of liner 1500 can be rotated about axis and the spade jet orientation will rotate equally in the same direction. For example, if the liner 1500 is rotated 45 degrees clockwise about the axis, the collapse plane will also rotate 45 degrees clockwise and the spade jet will stretch longitudinally forward on axis and laterally along the rotated collapse plane.

The included angle C of liner 1500 is needed to obtain Munroe effect jetting should be from 36 to 120 degrees. The jet velocity achieved from a shaped charge is dependent on the liner wall 109 thickness and included angle C of the liner; a narrower included angle results in a faster less massive jet, and a wider included angle results in a slower more massive jet. Jet velocities can vary from 4 to 10 km/s depending on the type and quality of liner material, included angle A of the liner, liner wall 109 thickness, the charge to mass ratio of HE to liner, bulk density of the liner, surface finish of the liner wall, and body geometries; very small changes of any of these variables can make large differences in jet velocity and trajectory.

The half pipe liner 1500 can be implemented with the non-liner components of the shape charge unit shown and described in FIGS. 1, 3A-B, 4, 6 (and related figures), where the HE billet 115 is contained between the inner surface 112 of body 110 and the outer surface 116 of the EW liner 105. HE billet 115 provides the energy to collapse the EW liner 105, increasing the ductility of the EW liner 105 material, causing it to form a compound jet in the shape of a very high speed rod jet from the full conical section 122 material followed by a flattened spade shaped jet from the liner wing section 133 material; the spade jet is slower than the rod jet from conical section 122 but much faster than a typical "V" shaped liner found in common linear shaped charge because of the cavity of the wing section 133.

The invention described and depicted herein produces a portion that is spread into a sheet like planar symmetric shape reminiscent of the jetting of a linear shaped charge. In order to achieve the greatest jet length and penetration depth the jetting process of a shaped charge requires the liner material to reach a high temperature during collapse, which allows plastic flow of the collapsed liner material and produces a long stretching jet. Since jet length and penetration are directly proportional it is reasonable to make the greatest effort to provide the longest and most robust jet possible.

The material of liner 1500 during collapse will produce a spade shaped jet, and the absence of explosive forces and material confinement about the "V" notches 1515 will force the liner material of the liner wall 1525 to spread much wider than the un-notched aft portion of the liner. Curvature of the liner concave flutes 1510 provides the necessary ductility to form a high speed stretching spade shaped jet from the collapsed liner material. This jet being spade shaped, stretching and high speed, produces a deep elongated hole in the target. Angle C of the liner walls can be between 36 and 120 degrees depending on desired jet characteristics.

It is also possible, the inventor that multiple follow on devices of the same size can be sequentially delivered into the hole, in a semi-infinite target, and their cumulative penetrations are taken advantage of, to extend this hole to extreme depths in any direction such as in oil well stimulation. Each time a charge is detonated in a hole such as oil or gas bearing formations the shock and concussion from the explosive will fracture the formation around it. Further as the high pressure gasses from the explosive dissipate a low pressure volume is created in the perforation hole inviting the formation pressure into the hole and clearing the hole surface of any debris or coating.

Shaped charge liners come in many shapes, angles and sizes, the disclosure in this patent application intends this wide variety of options (as shown in figure section) as part and parcel of the claims of this application. The liner 1500 embodiment can be used in a single device or an array of devices in a linear or peripheral path, which can be circular, polygonal, linear or a curved spline. The liner array can be made of individual devices as shown in FIG. 1 and FIG. 5 or a single liner array as shown in the FIG. 11 linear array and the FIG. 13 circular array. While the invention has been particularly shown and described with respect to preferred embodiments, it will be readily understood that minor changes in the details of the invention may be made without departing from the spirit of the invention. Having described the invention, we claim:

The invention claimed is:

1. A shaped charge explosive device having a longitudinal axis that extends along the length of the explosive device from a rearward end to a forward end, comprising:

a liner having a first parabolic liner section located from a apex longitudinal position to a vertex longitudinal position and a second winged liner section extending from said vertex longitudinal position to a winged base end at the forward end of the liner, said first parabolic liner section formed substantially in a parabolic shape rotated around the longitudinal axis with an apex of the first parabolic liner being located substantially near said longitudinal axis and toward the rearward end of the shaped charge explosive device, and said first parabolic liner section having walls extending circumferentially around the longitudinal axis and extending at an angle C.°/2 from said apex forward toward the vertex longitudinal length of the shaped charge explosive device;

said second winged liner section having two winged wall extensions, each winged wall extension being planar symmetric about a horizontal plane with the opposing winged wall extension, each winged wall extension having conical walls partially circumferentially rotated around the longitudinal axis between two winged arc ends and each said winged wall extensions located between said two winged arc ends extending from said vertex longitudinal length contiguous with the first parabolic liner section forward to a forward end of the liner of the shaped charge explosive device, and said winged arc ends at corresponding ends of opposing winged wall extensions having a face hollow concavity in the liner material on two opposing sides of the base end of the liner conical profile that extends from the winged vertex longitudinal length to each respective winged arc end for the opposing winged wall extensions, said each face hollow concavity being a parabolic shape extending from each winged arc end to said winged vertex longitudinal length and each face hollow concavity being planar symmetric about a vertical plane;

an explosive billet charge that surrounds said first parabolic liner section and surrounds the partially circumferential winged wall extensions with an additional charge located behind the conical apex of said liner;

an outer charge body that is an external containment casing surrounding said high explosive billet charge of the shaped charge explosive device and having two outer charge body walls located in the face hollow concavity in the liner material on two opposing sides of the base end of the liner parabolic profile that extends from the vertex longitudinal length to each respective winged arc end for the opposing winged wall extensions; and a detonator coupled to rearward end of high explosive billet charge for initiating detonation of the explosive charge, said detonator providing initiation to the high explosive billet to produce transform the liner into a symmetrical spade shaped projectile configuration.

2. A shaped charge explosive device of claim 1 wherein the angle of the conical walls on the second winged liner section are substantially aligned with the parabolic walls of said parabolic liner section.

3. A shaped charge explosive device of claim 1 wherein the angle of the conical walls on the second winged liner section are at an angle greater than the C.°/2 aligned with the parabolic walls of said parabolic liner section.

4. A shaped charge explosive device of claim 1 wherein the angle of the conical walls on the second winged liner section are at an angle less than the C.°/2 aligned with the parabolic walls of said parabolic liner section.

5. The shaped charge explosive device of claim 1 further comprising:

a frustoconical portion of the outer charge body located near the rearward end of the shaped charge device and positioned proximate to a detonator holder.

6. A shaped charge explosive device having a longitudinal axis that extends along the length of the explosive device from a rearward end to a forward end, comprising:

a liner having a first parabolic liner section located from an apex longitudinal position to a vertex longitudinal position and a second winged liner section extending from said vertex longitudinal position to a base end at the forward end of the liner, said first parabolic liner section formed substantially in a parabolic shape circumferentially rotated around the longitudinal axis with an apex of the first parabolic liner being located substantially near said longitudinal axis and toward the rearward end of the shaped charge explosive device, and said first parabolic liner section having parabolic walls extending circumferentially around the longitudinal axis and extending at an angle C.°/2 from said apex forward toward the vertex longitudinal length of the shaped charge explosive device;

said second winged liner section having two winged wall extensions, each winged wall extension having conical walls partially circumferentially rotated around the longitudinal axis between two winged arc ends and each said winged wall extensions located between said two winged arc ends extending from said winged vertex longitudinal length contiguous with the first parabolic liner section forward to a forward end of the liner of the shaped charge explosive device, and said winged arc ends at corresponding ends of opposing winged wall extensions having a face hollow concavity in the liner material on two opposing sides of the base end of the liner conical profile that extends from the winged vertex longitudinal length to each respective winged arc end for the opposing winged wall extensions;

an explosive billet charge that surround said first parabolic liner section and surrounds the partially circumferential winged wall extensions with an additional charge located behind the apex of said liner;

an outer charge body that is an external containment casing surrounding said high explosive billet charge of the shaped charge explosive device and having two outer charge body walls located in the face hollow concavity in the liner material on two opposing sides of the base end of the liner conical profile that extends from the vertex longitudinal length to each respective winged arc end for the opposing winged wall extensions; and a detonator coupled to rearward end of high explosive billet charge for initiating detonation of the explosive charge, said detonator providing initiation to the high explosive billet to produce transform the liner into a spade shaped like projectile having a symmetrical configuration.

7. The shaped charge explosive device of claim 6 wherein each said winged wall extension is planar symmetric about a horizontal plane.

8. A shaped charge explosive device of claim 6 wherein said face hollow concavity between each winged arc end said opposing winged wall extension is a parabolic shape extending from each winged arc end to said winged vertex longitudinal length.

9. A shaped charge explosive device of claim 8 wherein each said face hollow concavity is planar symmetric about a vertical plane.

10. A shaped charge explosive device of claim 6 wherein the angle of the conical walls on the second winged liner section are substantially aligned with the conical walls of said first full conical liner section.

11. A shaped charge explosive device of claim 6 wherein the angle of the conical walls on the second winged liner section are at an angle greater than the C.°/2 aligned with the conical walls of said first full conical liner section.

12. A shaped charge explosive device of claim 6 wherein the angle of the conical walls on the second winged liner section are at an angle less than the C.°/2 aligned with the conical walls of said first full conical liner section.

13. The shaped charge explosive device of claim 6 further comprising:

a frustoconical portion of the outer charge body located near the rearward end of the shaped charge device and positioned proximate to a detonator holder.

14. A method for making a shaped charge explosive device having a longitudinal axis that extends along the length of the explosive device from a rearward end to a forward end, comprising the steps of:

providing a liner having a first parabolic liner section located from an apex longitudinal position to a vertex longitudinal position and a second winged liner section extending from said vertex longitudinal position to a winged base end at the forward end of the liner;

said first parabolic liner section formed substantially in a parabolic shape circumferentially rotated around the longitudinal axis with an apex of the first parabolic liner being located substantially near said longitudinal axis and toward the rearward end of the shaped charge explosive device, and said first parabolic liner section having conical walls extending circumferentially around the longitudinal axis and extending at an angle C.°/2 from said cone apex forward toward the winged vertex longitudinal length of the shaped charge explosive device;

said second winged liner section having two winged wall extensions, each winged wall extension having conical walls partially circumferentially rotated around the longitudinal axis between two winged arc ends and each said winged wall extensions located between said two winged arc ends extending from said winged vertex longitudinal length contiguous with the first parabolic liner section forward to a forward end of the liner of the shaped charge explosive device, and said winged arc ends at corresponding ends of opposing winged wall extensions having a face hollow concavity in the liner material on two opposing sides of the base end of the liner parabolic profile that extends from the vertex longitudinal length to each respective winged arc end for the opposing winged wall extensions;

coupling an explosive billet charge to surround said first parabolic liner section and surrounds the partially circumferential winged wall extensions and an additional charge located behind the apex of said liner;

coupling an outer charge body that is an external containment casing to surround said high explosive billet charge of the shaped charge explosive device, said outer charge body having two outer charge body walls located in the face hollow concavity in the liner material on two opposing sides of the base end of the liner parabolic profile that extends from the vertex longitudinal length to each respective winged arc end for the opposing winged wall extensions; and coupling a detonator to rearward end of high explosive billet charge for initiating detonation of the explosive charge, said detonator providing initiation to the high explosive billet to produce transform the liner into a spade shaped like projectile having a symmetrical configuration.

15. The method of making the shaped charge explosive device of claim 14 wherein each said winged wall extension is planar symmetric about a horizontal plane.

16. The method of making the shaped charge explosive device of claim 14 wherein said face hollow concavity between each winged arc end said opposing winged wall extension is a parabolic shape extending from each winged arc end to said winged vertex longitudinal length.

17. The method of making the shaped charge explosive device of claim 16 wherein each said face hollow concavity is planar symmetric about a vertical plane.

18. The method of making the shaped charge explosive device of claim 14 wherein the angle of the conical walls on the second winged liner section are substantially aligned with the parabolic walls of said first parabolic liner section.

19. The method of making the shaped charge explosive device of claim 14 wherein the angle of the conical walls on the second winged liner section are at an angle greater than the C.°/2 aligned with the parabolic walls of said first parabolic liner section.

20. The method of making the shaped charge explosive device of claim 14 wherein the angle of the conical walls on the second winged liner section are at an angle less than the C.°/2 aligned with the parabolic walls of said first parabolic liner section.

21. The method of making the shaped charge explosive device of claim 14 wherein said outer charge body possesses a frustoconical portion of the outer charge body located near the rearward end of the shaped charge device and positioned proximate to a detonator holder.

* * * * *